US010669052B2

(12) United States Patent
Goodhind

(10) Patent No.: US 10,669,052 B2
(45) Date of Patent: Jun. 2, 2020

(54) MODULAR BALER

(71) Applicant: Michael A. Goodhind, Phoenix, AZ (US)

(72) Inventor: Michael A. Goodhind, Phoenix, AZ (US)

( * ) Notice: Subject to any disclaimer, the term of this patent is extended or adjusted under 35 U.S.C. 154(b) by 195 days.

(21) Appl. No.: 15/795,652

(22) Filed: Oct. 27, 2017

(65) Prior Publication Data

US 2019/0127096 A1 May 2, 2019

(51) Int. Cl.

| | |
|---|---|
| ***B65B 13/20*** | (2006.01) |
| ***B65B 13/18*** | (2006.01) |
| ***B65B 27/12*** | (2006.01) |

(52) U.S. Cl.

CPC ..... *B65B 13/20* (2013.01); *B65B 13/188* (2013.01); *B65B 27/12* (2013.01)

(58) Field of Classification Search

CPC ..... B65B 13/20; B65B 13/188; B65B 27/12; B30B 9/00; B30B 9/32; B30B 9/301; B30B 9/321; B30B 9/3007; B30B 9/3078; A01F 15/00; B02C 19/0062; B23D 31/008; B65F 3/00

USPC ... 100/35, 39, 88, 98 R, 100, 215, 218, 226, 100/232; 241/3; 296/183.1

See application file for complete search history.

(56) References Cited

U.S. PATENT DOCUMENTS

| | | | | |
|---|---|---|---|---|
| 823,703 A | | 6/1906 | Sharp | |
| 2,413,054 A | * | 12/1946 | Langford | A01F 15/0841 100/226 |
| 2,644,351 A | * | 7/1953 | Golay | B30B 9/32 100/232 |
| 3,377,946 A | | 4/1968 | Garland | |
| 3,643,873 A | | 2/1972 | George | |
| 4,018,169 A | * | 4/1977 | Schmalz | B30B 9/301 100/39 |
| 4,062,281 A | | 12/1977 | Tripp | |
| 4,557,190 A | | 12/1985 | Vezzani | |

(Continued)

OTHER PUBLICATIONS

JM Recycling Systems Ltd, Nottingham NG7 2SD, UK © 2013 McIntyre 407 Alligator Shear https://jmcrecycling.com/products/mcintyre-407-alligator-shear/ (Year: 2013).*

*Primary Examiner* — Shelley M Self
*Assistant Examiner* — Fred C Hammers
(74) *Attorney, Agent, or Firm* — Kenneth Motolenich-Salas

(57) ABSTRACT

A modular baler comprises a baling chamber; a displaceable pusher block in the baling chamber interior; a hydraulic cylinder comprising a cylinder rod displaceable into and out of a cylinder casing; a shear module; and wherein the baling chamber is attachable to the cylinder frame, with the cylinder rod attached to the pusher block. The baler fits in elevators unlike prior art. The shear module cuts material that is placed into the baling chamber. When the baling chamber is full, the baling chamber top is closed. Pressurized hydraulic oil flows into the cylinder rod, causing its longitudinal displacement, causing the longitudinal displacement of the pusher block which is attached to the cylinder rod, thereby compressing material in the baling chamber. The material is removed from the baling chamber, providing volume reduction of scrap waste metal over prior art.

20 Claims, 16 Drawing Sheets

(56) References Cited

U.S. PATENT DOCUMENTS

| | | | | |
|---|---|---|---|---|
| 5,142,779 | A * | 9/1992 | LaBounty | B23D 17/00 144/24.12 |
| 5,247,881 | A * | 9/1993 | Rosser | B30B 9/3007 100/215 |
| 5,779,300 | A | 7/1998 | McNeilus | |
| 5,899,139 | A * | 5/1999 | Dorman | B30B 9/3096 100/100 |
| 6,546,855 | B1 | 4/2003 | Van Der Beek | |
| 6,837,158 | B2 * | 1/2005 | Simpson | B30B 9/3021 100/179 |
| 7,467,507 | B2 | 12/2008 | Viaud | |
| 8,707,864 | B2 | 4/2014 | Fritz | |
| 8,776,680 | B2 | 7/2014 | Zimmerman | |
| 8,967,040 | B2 | 3/2015 | Fritz | |
| 2015/0272009 | A1 | 10/2015 | Adams | |
| 2017/0001400 | A1 * | 1/2017 | Gaudreault | B30B 9/3035 |
| 2017/0142906 | A1 * | 5/2017 | Benevelli | A01F 15/0841 |

* cited by examiner

MODULAR BALER

FIELD OF THE INVENTION

The present invention relates to a modular baler.

BACKGROUND OF THE INVENTION

Industrial balers are used in a variety of industries to compact various types of waste, such as office paper, fiberboard, plastic, metal (including foil and can for sale to recycling companies). These balers are made of steel with a hydraulic ram to compress the material loaded. Some balers are simple and labor-intensive, but are suitable for smaller volumes while other balers are very complex and automated, and are used where large quantities of waste are handled.

In the demolition, construction, remediation, or remodeling of structures, waste metal is generated. Balers are generally made of steel with a hydraulic ram to compress the waste material loaded onto the baler. In the prior art, a variety of baler designs exist. However, across these designs, common problems exist.

First, balers often are sized to not easily fit inside elevators or smaller interior spaces or are sized such that the movement of the baler into/out of an elevator or into/out of the interior space causes damage to the elevator or interior space. As such, there is a need in the art for balers that can be sized or modularized to allow for ease of transport into/out of elevators and into/out of smaller interior spaces.

Secondly, balers are volume limited, that is, limited in the amount of volume of waste metal material the baler can have loaded and thereafter compressed. The smaller the volume of the waste metal material compressed by the baler, the more waste metal material the baler can compress without having to stop or interrupt baling and unload the compacted waste metal material from the baler and the related lost time waiting for baler unloading/loading operations or elevator transport. As such, there is a need in the art for balers that are able to maximize the compression ability of the baler and compress as much waste metal material ((by weight) into as small a volume as possible, i.e., maximize the density of the compressed waste metal material (weight of waste metal material compressed by the baler per volume of the resultant compressed waste metal material).

Thirdly, balers require the use of trained professionals. The larger the number of professionals needed to operate the baler (i.e., the more complex) for any given project, the less amount of available labor exists for other needed work associated with the project. Moreover, the more difficult it is to assemble/disassemble the baler, the more time is needed for assembly/disassembly and the less time exists for the available labor to complete other needed work associated with the project. As such, there is a need in the art for balers that are simple to operate, assemble, and disassemble.

Fourthly, each individual baling cycle (loading of material, compressing of material, unloading of compressed material) should be as short as possible. The longer the baling cycle, the longer project completion time will be. As such, there is a need in the art for balers capable of compressing material in as short an individual baling cycle time as possible while not sacrificing volume-maximization capabilities.

Fifthly, the compressed baled material has to be transported from the project site to ultimate disposition. Often, balers do not have the transport volume necessary to accomplish this task, which requires the use of a dumpster and the related dumpster rental or purchase cost, increasing the cost of the overall job. As such, there is a need in the art for balers capable of providing sufficient compressed waste metal material storage volume so as to obviate or minimize the need for separate dumpster use.

Sixthly, the waste metal material to be compressed and the compressed baled material must be handled by personnel in many instances. Often, such material, which can comprise studs, conduit, ceiling grid, hanger wires, light fixtures, HVAC components, and ductwork, has sharp edges/surfaces or contain or comprise dangerous, sharp, toxic, noxious, or other harmful materials or substances. Moreover, many such materials are bulky and hard to handle. Further, many of these materials may inadvertently damage interior walls or surfaces of elevators given their rough or sharp nature. As such, there is a need in the art for modular balers capable of minimizing the exposure of personnel to such material during baler operations and risk of such materials causing damage to other structures while sized or modularized to allow for ease of transport into/out of elevators and into/out of smaller interior spaces.

SUMMARY OF THE INVENTION

A first aspect of the invention comprises a modular baler comprising a baling chamber with a substantially hollow interior; a pusher block positioned in the baling chamber interior that is displaceable; a cylinder frame; a hydraulic cylinder attached to the cylinder frame comprising a cylinder rod that is hydraulically displaceable into and out of a cylinder casing and a plurality of hydraulic oil ports attached to the cylinder casing; an electrical power/hydraulic system module comprising (i) a source of hydraulic oil; (ii) means for connecting to an electrical power source; (iii) an electrical motor electrically connected to an electrical power source through such means; (iv) a hydraulic oil pump electrically connected to the electrical motor and in fluid communication with the source of hydraulic oil and the hydraulic cylinder through the plurality of hydraulic oil ports; a shear module electrically connected to an electrical power source through such means for connecting to an electrical power source and in fluid communication with the source of hydraulic oil; and wherein the baling chamber is attachable to the cylinder frame at a plurality of baling chamber-cylinder frame attachment points and wherein one such attachment point comprises the attachment of the cylinder rod to the pusher block.

A second aspect comprises a modular baler comprising (a) a baling chamber with a substantially hollow interior, anterior and posterior and comprising a front structural member and a rear structural member; a front wall attached to the front structural member and a rear wall attached to the rear structural member; a top door hingedly attached to the rear wall; means for locking the top door; an upper structural member and a lower structural member each attached to the front wall and the rear wall; a plurality of top door hydraulic cylinders for hydraulically moving the top door attached to at least one of the lower structural member, rear structural member, and rear wall; an anterior door frame attached to one or more of the rear wall, the front wall, the upper structural member, and the lower structural member; an anterior door hingedly attached to the anterior door frame wherein the anterior door is closable on the anterior door frame so as to close off the substantially open anterior; and a pusher block positioned in the substantially hollow baling chamber interior between the front wall and rear wall wherein the pusher block (i) is in contact with at least one wall, (ii) is displaceable, and (iii) has positioned in the pusher block interior a pusher block hub; (b) a cylinder frame comprising a front structural member, a rear structural member, and a posterior structural member attached to the front structural member and the rear structural member; a hydraulic cylinder attached to the cylinder frame comprising a cylinder rod that is hydraulically displaceable into and out of a cylinder casing and wherein a plurality of hydraulic oil ports is attached to the cylinder casing; (c) an electrical power/hydraulic system module attached to the cylinder frame and comprising (i) a source of hydraulic oil, (ii) means for connecting to an electrical power source, (iii) an electrical control panel attached to such means, (iv) an electrical motor electrically connected with the electrical control panel, (v) a hydraulic oil pump physically connected to the electrical motor, (vi) a control valve for operation of the top door hydraulic cylinders and the cylinder rod, (vii) a shear valve electrically connected with the electrical control panel, and (viii) wherein the hydraulic pump is in fluid communication with the source of hydraulic oil, the hydraulic cylinder through the plurality of hydraulic oil ports, the top door hydraulic cylinders, the control valve, and the shear valve; (d) a shear module (i) attached to the cylinder frame, (ii) in fluid communication with the source of hydraulic oil through the shear valve, and (iii) electrically connected to the control panel; and (e) wherein the baling chamber is attachable to the cylinder frame at the posterior of the baling chamber and the anterior of the cylinder frame comprising a plurality of baling chamber-cylinder frame attachment points and wherein one such attachment point comprises the attachment of the cylinder rod to the pusher block hub.

A third aspect comprises a modular baler comprising a baling chamber with a substantially hollow interior, a top door that is movable, and means for hydraulically moving the top door; a pusher block positioned in the interior of a baling chamber that is displaceable; a pusher block hub positioned in the interior of the pusher block; a cylinder frame comprising one or more structural members, and one or more lateral support bars, each bar attached to at least one structural member; a hydraulic cylinder (i) attached to at least one of one or more lateral support bars (ii) comprising a cylinder rod that is displaceable into and out of a cylinder casing, wherein a plurality of hydraulic oil ports is attached to the cylinder casing; an electrical power/hydraulic system module attached to the cylinder frame comprising (i) a source of hydraulic oil, (ii) means for connecting to an electrical power source, (iii) an electrical motor electrically connected to an electrical power source through such means; and (iv) a hydraulic oil pump electrically connected to the electrical motor and in fluid communication with the source of hydraulic oil, means for hydraulically moving the top door, and the hydraulic cylinder through the plurality of hydraulic oil ports; a shear module (i) electrically connected to an electrical power source through such means for connecting to an electrical power source and (ii) in fluid communication with the source of hydraulic oil through the hydraulic oil pump; and wherein the baling chamber is attachable to the cylinder frame at a plurality of the baling chamber-cylinder frame attachment points and wherein one such attachment point comprises the attachment of the cylinder rod to the pusher block hub.

Further additional, advantageous aspects of the invention, such as variants of the aspects of the invention disclosed above, will become apparent to one of ordinary skill in the art upon review of the following description of the embodiments of the invention and the claims and with reference to the accompanying drawings.

By way of example only, specific embodiments of the invention will now be described, with reference to the accompanying drawings, in which:

DESCRIPTION OF THE DRAWINGS

An embodiment of the invention is now described by way of example and with reference to the accompanying drawings.

DETAILED DESCRIPTION OF THE PREFERRED EMBODIMENTS

Figure 9:
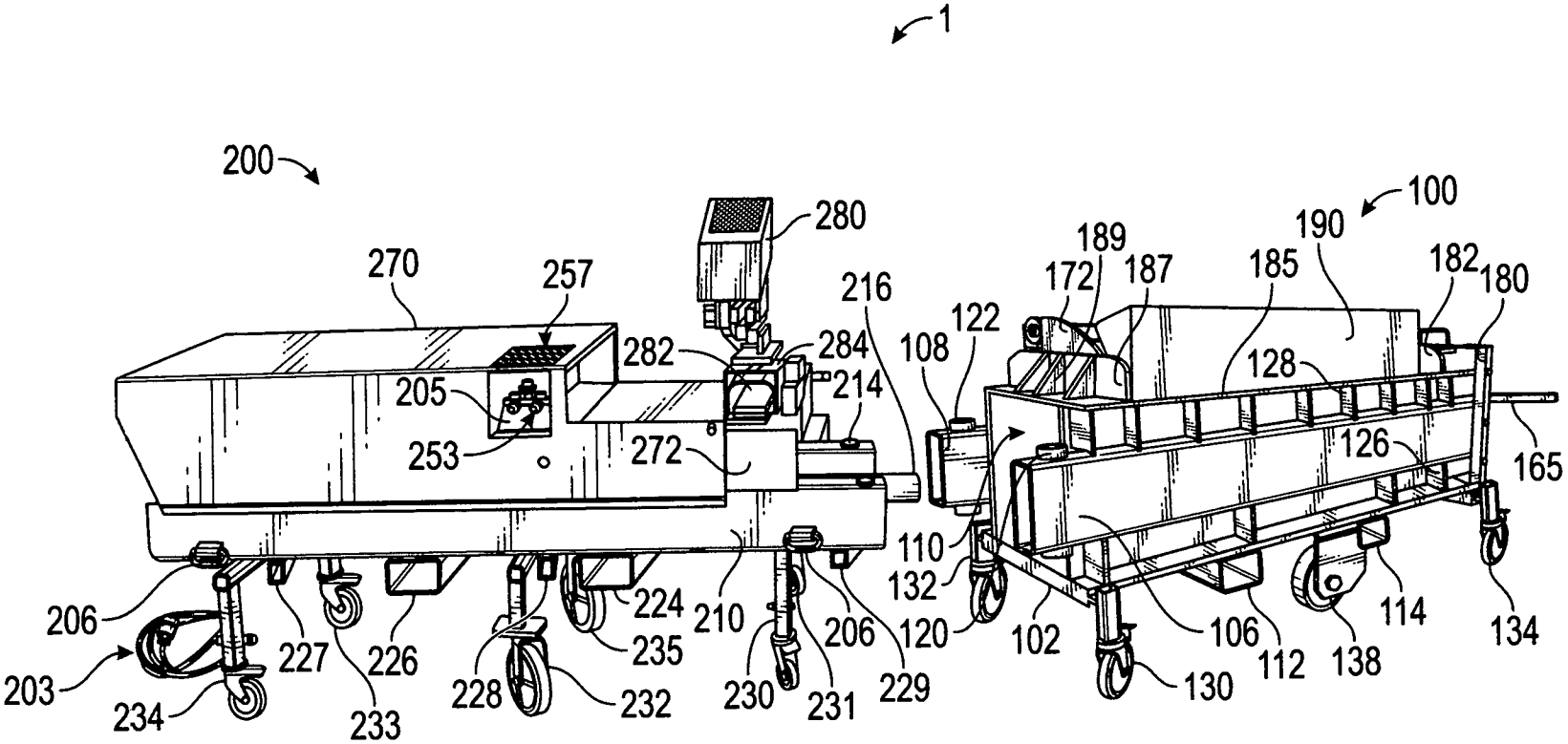
FIG. 9 is a side view of an embodiment of the present invention.
Figure 10:
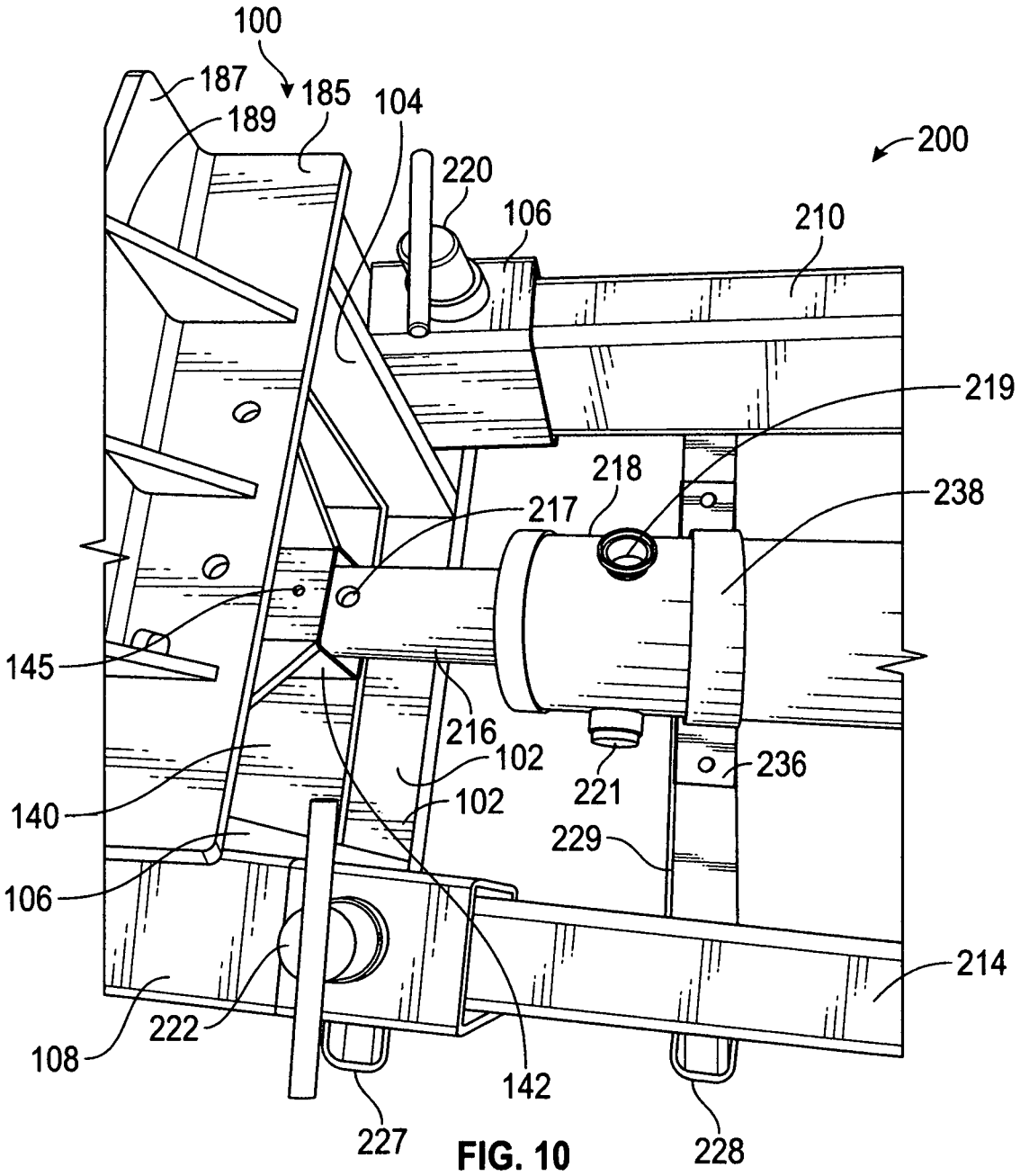
FIG. 10 is an elevated view of the posterior of the baling chamber and the anterior of the cylinder frame of an embodiment of the present invention.
Figure 11:
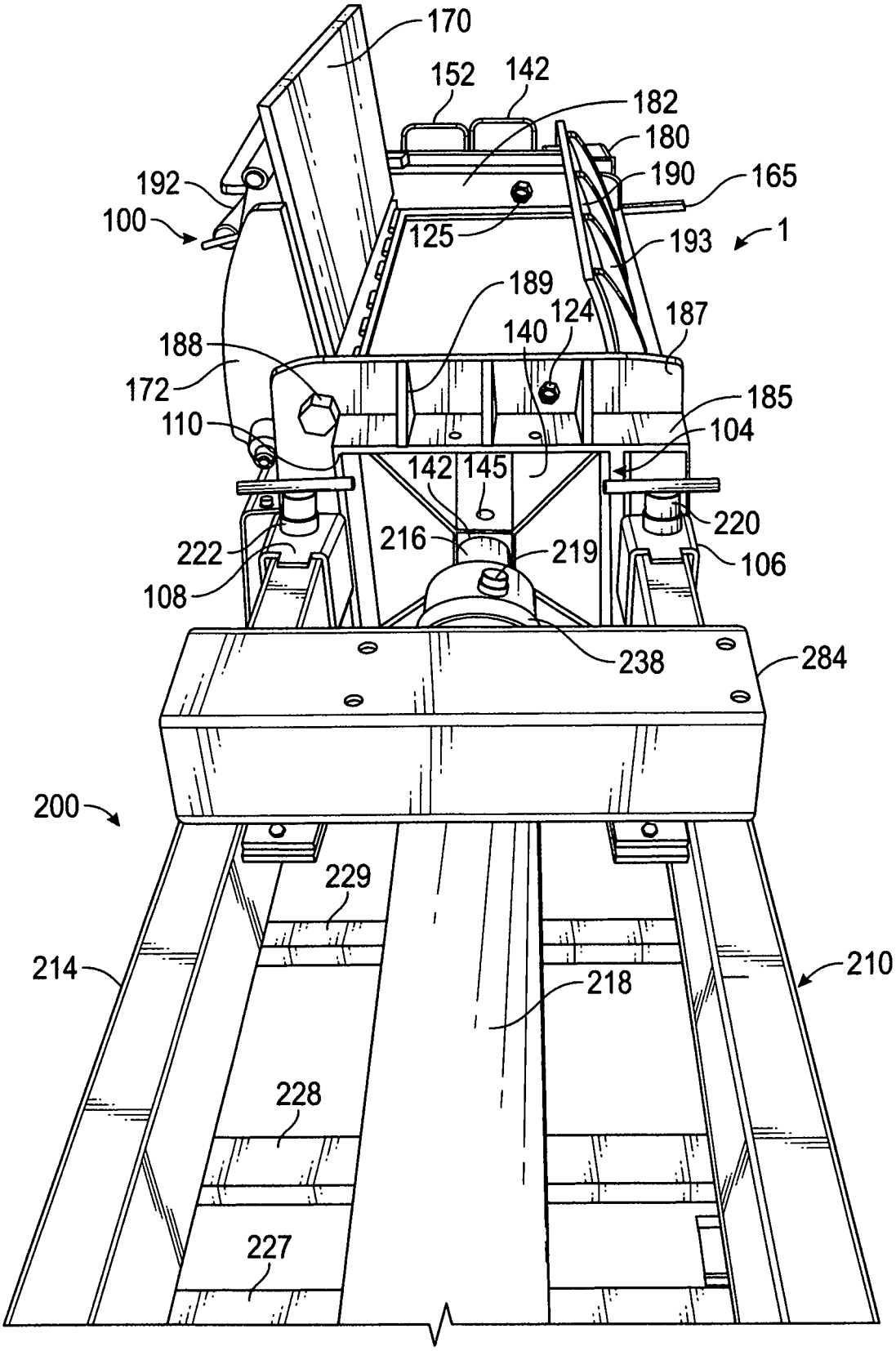
FIG. 11 is a perspective view of an embodiment of the present invention.
Figure 12:
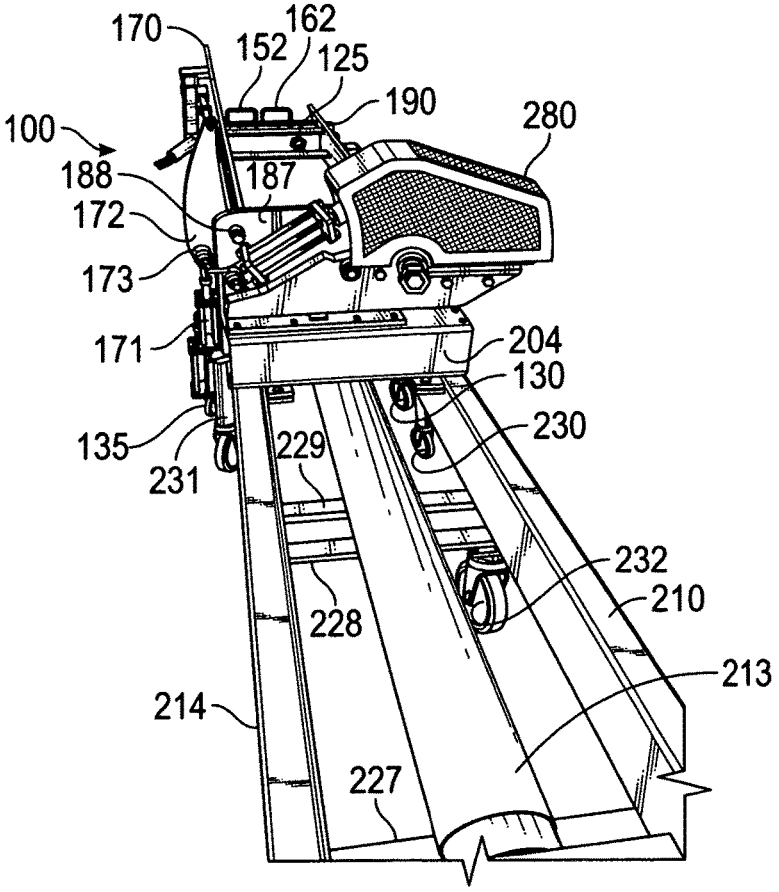
FIG. 12 is a partial perspective view of an embodiment of the present invention.

Orientation: As used in this specification and with respect to modular baler 1, the terms anterior and posterior refer to the right and left sides of the modular baler 1, respectively, along a longitudinal axis from the perspective of a person facing the modular baler 1 and viewing the modular baler 1 such that the modular baler 1 is oriented as in FIG. 9, and the terms front and rear refer to the foreground and background of modular baler 1, respectively, from the perspective of a person facing the modular baler 1 and viewing modular baler 1 such that the modular baler is oriented as in FIG. 9.

With reference to the above-described figures, modular baler 1 comprises (i) baling chamber 100, (ii) cylinder frame 200 attachable to baling chamber 100 wherein the anterior of cylinder frame 200 is attachable at one or more, preferably a plurality of, attachment points to the posterior of baling chamber 100, (iii) shear module 280 positioned at and attachable to the anterior of cylinder frame 200, and (iv) electrical power/hydraulic system module 202, positioned at and attached to the posterior of cylinder frame 200, that provides a source of electrical power and hydraulic oil via electrical and hydraulic line connections, respectively, to elements of baling chamber 100 and cylinder frame 200. Preferably, each of baling chamber 100 and cylinder frame 200 has one or more fork pockets, as further described herein, below their respective front or rear ends, preferably the front ends, to accommodate the ends of a forklift fork.

Baling Chamber: Baling chamber 100 comprises baling chamber front structural member 106, baling chamber rear structural member 108, baling chamber front wall 104, baling chamber rear wall 110, baling chamber upper structural member 185, baling chamber lower structural member 102, top door 170, and baling chamber anterior door frame 180. The baling chamber front structural member 106, baling chamber front wall 104, baling chamber rear structural member 108, baling chamber rear wall 110, lower structural member 102 and baling chamber upper structural member 185 define a longitudinal axis of baling chamber 100. The width (lateral dimension) of structural members 102 and the lateral distance separating front and rear structural members 106 and 108 define a lateral axis of baling chamber 100. Each of structural members 102, 106, 108, and 185, walls 104 and 110, top door 170, and baling chamber anterior door frame 180 can be comprised of either (i) one integral structure, wherein each is formed from one structure, or (ii) a plurality of structural members attached together to form each respective single structure. Top door 170 may be opened and closed using any one or more known methods in the art. Preferably, top door 170 is hydraulically moved through means for hydraulically moving the top door 170. Alternatively, top door 170 is moved manually or by a crane.

Figure 1:
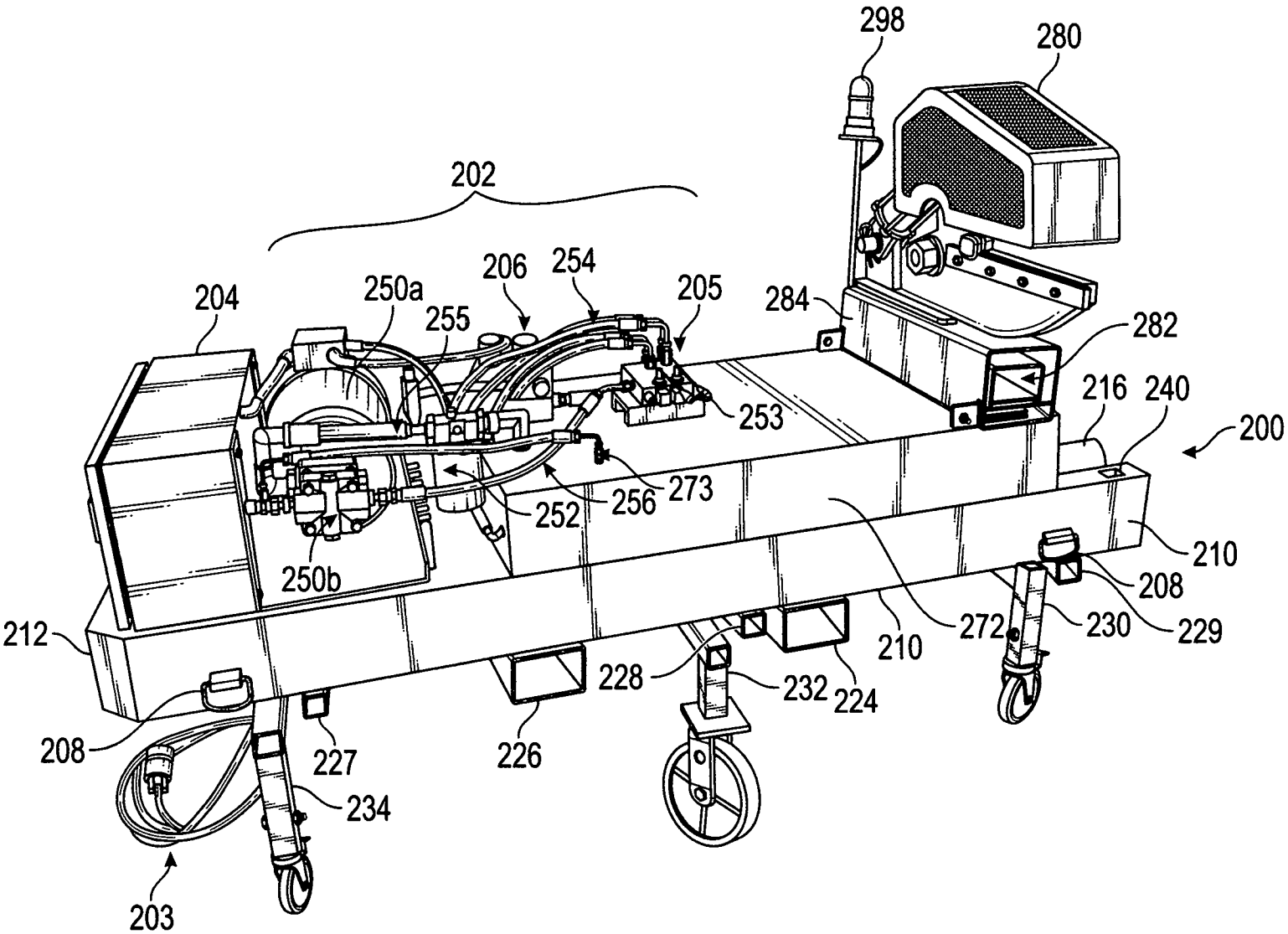
FIG. 1 is a perspective view of the cylinder frame with electrical power/hydraulic system module at the posterior end of the cylinder frame and with the shear module at the anterior end of the cylinder frame of an embodiment of the present invention.
Figure 2:
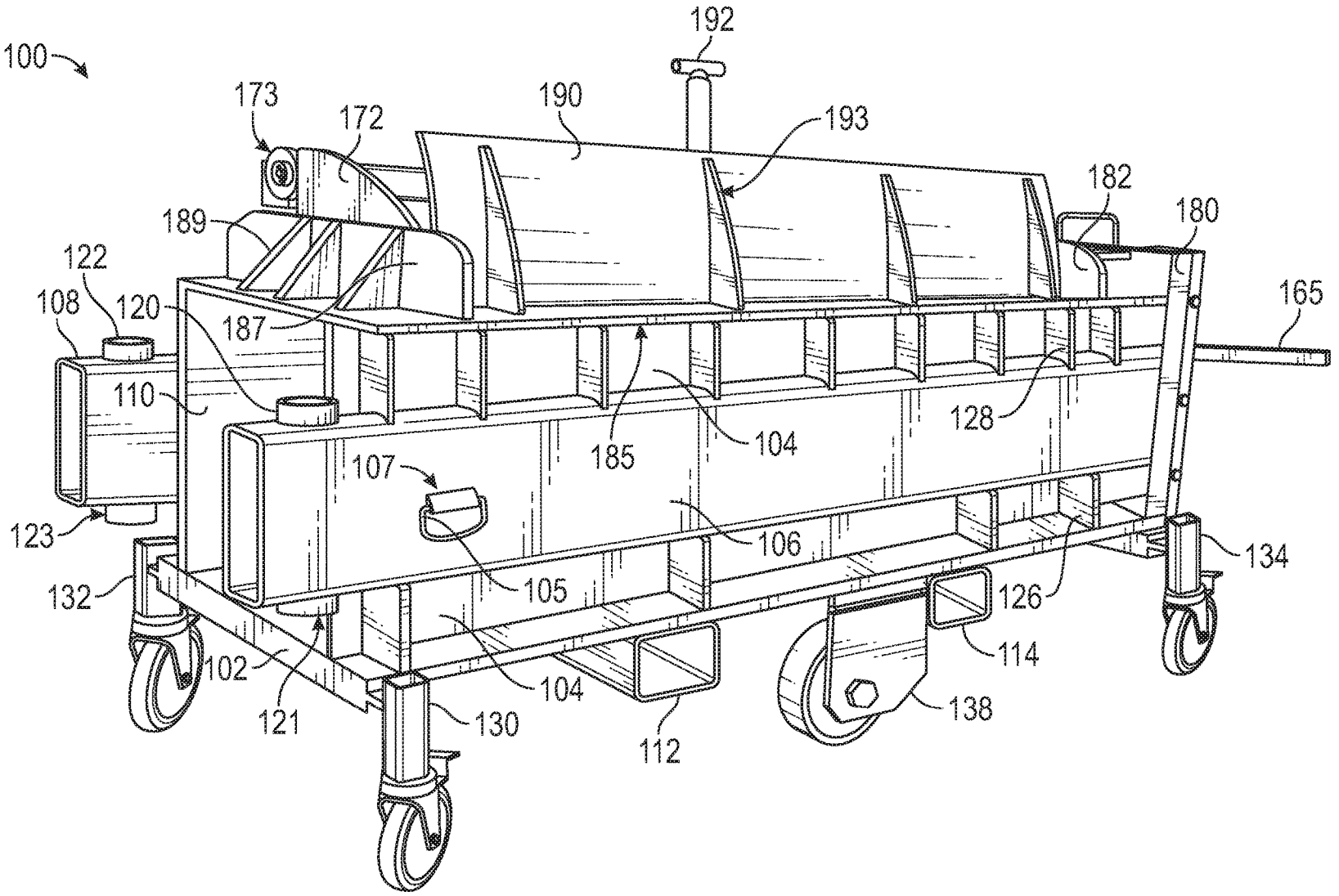
FIG. 2 is a side perspective view of the baling chamber of an embodiment of the present invention.
Figure 3:
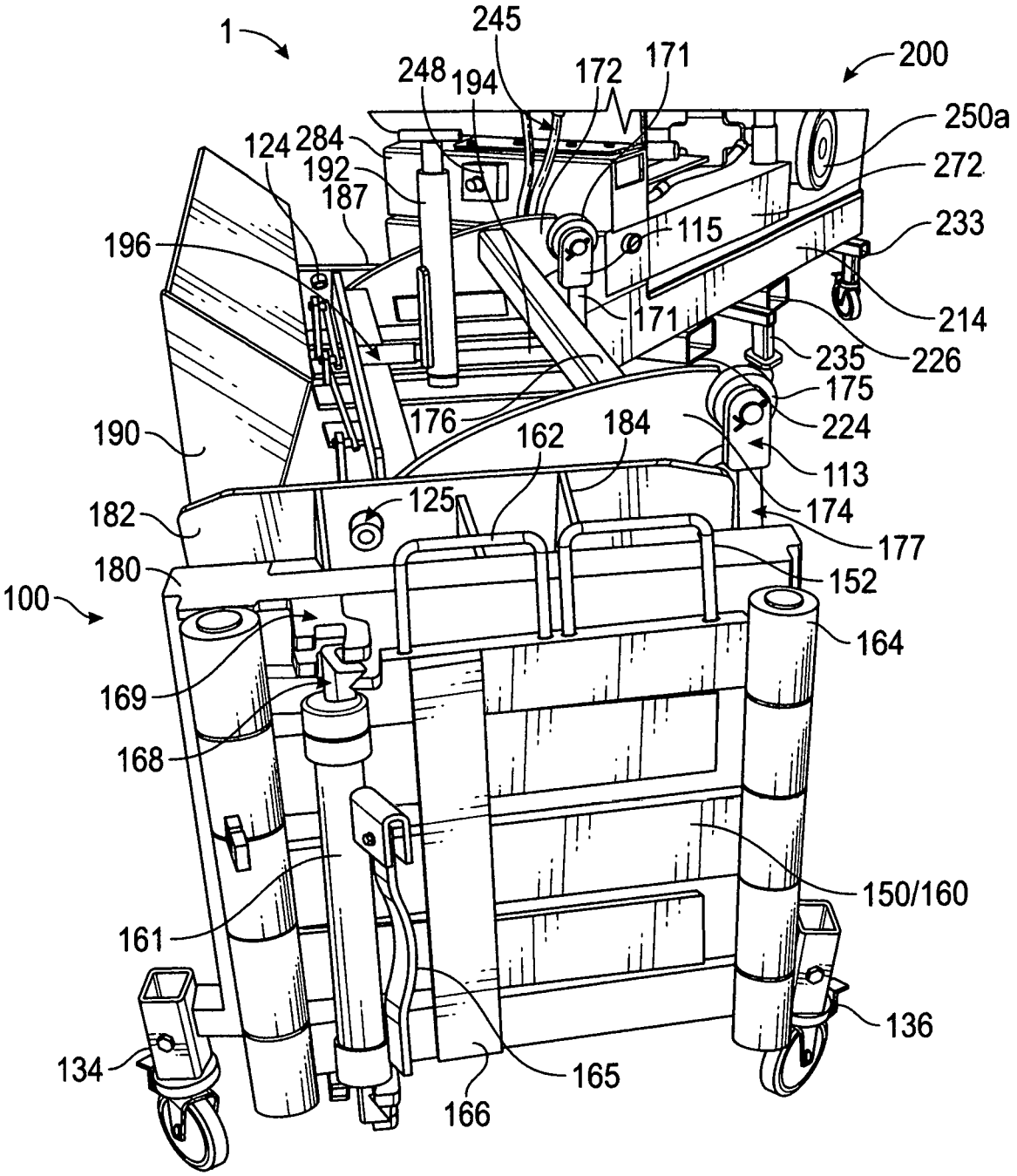
FIG. 3 is a perspective view of an embodiment of the present invention.
Figure 4:
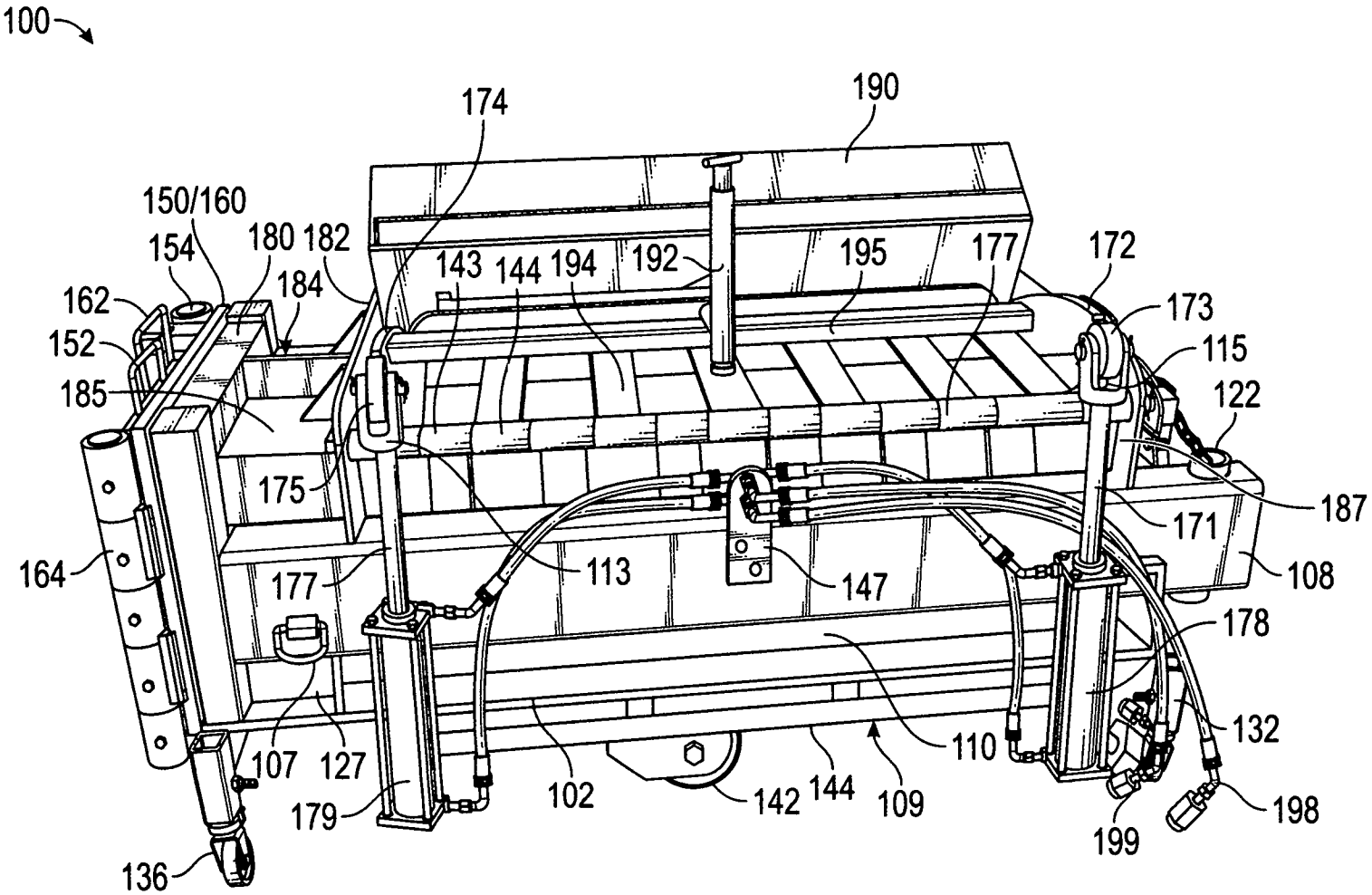
FIG. 4 is a side view of the baling chamber of an embodiment of the present invention.
Figure 5:
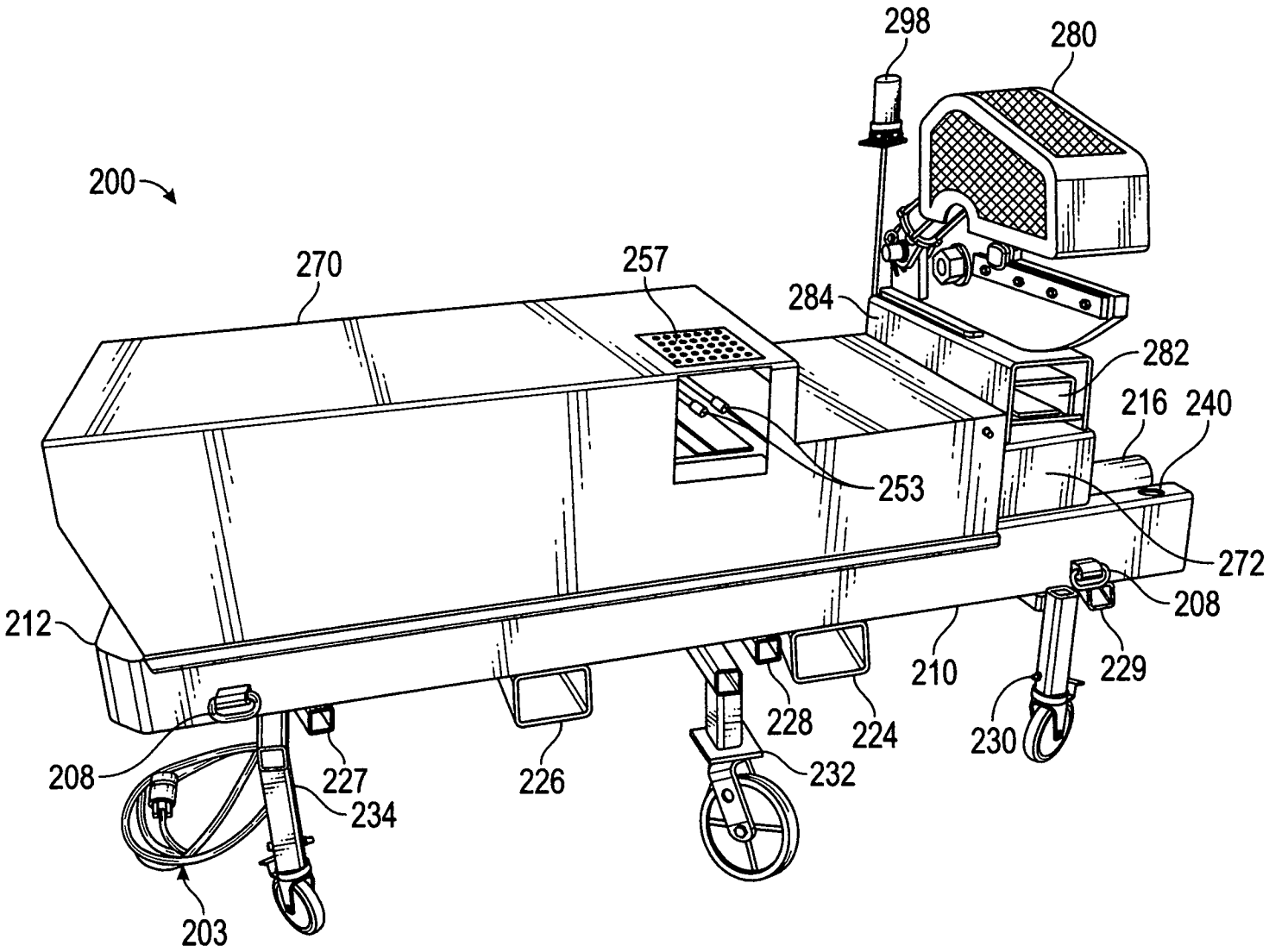
FIG. 5 is a side view of the cylinder frame with the shear module at the anterior end of the cylinder frame of an embodiment of the present invention.

Baling chamber lower structural member 102 is a solid (non-hollow interior) structure and has an anterior lateral end, a front longitudinal end in contact with the anterior lateral end at the lower front anterior corner of baling chamber 100, a posterior lateral end in contact with the front longitudinal end at the lower front posterior corner of baling chamber 100, and a rear longitudinal end in contact with the posterior lateral end at the lower rear posterior corner of baling chamber 100 and in contact with the anterior lateral end at the lower rear anterior corner of baling chamber 100. Preferably and with reference to FIGS. 2, 9, and 13, attached to the underside of baling chamber lower structural member 102 is one or more fork pockets, preferably a plurality of baling chamber fork pockets with an anterior baling chamber fork pocket 114 under the front longitudinal end of baling chamber lower structural member 102, and posterior baling chamber fork pocket 112 under the front longitudinal end of baling chamber lower structural member 102. Baling chamber lower structural member 102 attaches to baling chamber anterior door frame 180, with the anterior lateral end of baling chamber lower structural member 102 attached to the lower perimeter segment of baling chamber door frame 180.

Baling chamber front structural member 106 is attached to and in contact with baling chamber front wall 104 substantially the entire longitudinal length of baling chamber front wall 104.

Baling chamber rear structural member 108 is attached to and in contact with baling chamber rear wall 110 substantially the entire longitudinal length of baling chamber rear wall 110.

With reference to FIGS. 2-4 and 7-16, baling chamber rear structural member 108 is attached to and in contact with baling chamber rear wall 110 substantially the entire longitudinal length of baling chamber rear wall 110. Preferably, the posterior of baling chamber rear structural member 106 extends longitudinally posterior of the posterior lateral end of baling chamber lower structural member 102.

The posterior ends of baling chamber front structural member 106 and baling chamber rear structural member 108 are substantially similar and comprise perimeter segments (upper, lower, front, rear) surrounding an open (hollow) interior, with the upper perimeter segment of each structural member having an aperture. The upper perimeter segment of baling chamber front structural member 106 has aperture 120 and lower perimeter segment having aperture 121 that is substantially concentric with aperture 120. Preferably, each of apertures 120 and 121 are substantially circular in cross section. More preferably, a cylindrical structural member extends vertically upward from aperture 120 and a cylindrical structural member extends vertically downward from aperture 121.

The upper perimeter segment of rear structural member 108 has aperture 122 and the lower perimeter segment has aperture 123 that is substantially concentric with aperture 122. Preferably, each of apertures 122 and 123 are substantially circular in cross section. More preferably, a cylindrical structural member extends vertically upward from aperture 122 and a cylindrical structural member extends vertically downward from aperture 123.

Baling chamber front structural member 106 and baling chamber rear structural member 108 can be comprised of either (i) one integral structure, wherein structural member 106 is formed from one structure, or (ii) a plurality of structural members attached together. Moreover, baling chamber front structural member 106 and baling chamber rear structural member 108 can comprise either solid or hollow structures anterior of the apertures at the posterior ends of structural members 106 and 108. Preferably, members 106 and 108 are substantially hollow anterior the apertures at the posterior ends of members 106 and 108, more preferably such hollowness extending substantially the longitudinal length of members 106 and 108.

The anterior ends of baling chamber front structural member 106 and baling chamber rear structural member 108 are attached to the posterior of baling chamber anterior door frame 180. Anterior door frame 180 comprises a plurality of perimeter segments (upper, front, lower, and rear) surrounding a hollow interior with no anterior or posterior surfaces perpendicular to the lateral axis of baling chamber 100 extending between the front and rear perimeter segments of anterior door frame 180. In a preferred embodiment, baling chamber anterior door frame 180 is attached to baling chamber front structural member 106, baling chamber rear structural member 108, baling chamber front wall 104, baling chamber rear wall 110, baling chamber upper structural member 185, and baling chamber lower structural member 102. In this preferred embodiment, baling chamber front structural member 106 attaches to baling chamber anterior door frame 180 proximal the anterior front of baling chamber 100, with the anterior end of baling chamber front structural member 106 attached to front perimeter segment of baling chamber door frame 180. Baling chamber rear structural member 108 attaches to baling chamber anterior door frame 180 proximal the anterior rear of baling chamber 100, with the anterior end of baling chamber rear structural member 108 attached to rear perimeter segment of baling chamber door frame 180. Baling chamber front wall 104 attaches to the baling chamber anterior door frame 180 proximal the anterior front of baling chamber 100, with the anterior end of baling chamber front wall 104 attached to front perimeter segment of baling chamber anterior door frame 180 to the rear of the attachment of the anterior end of baling chamber front structural member 106 to the front perimeter segment of baling chamber anterior frame 180. Baling chamber rear wall 110 attaches to baling chamber anterior door frame 180 proximal the anterior rear of baling chamber 100, with the anterior end of baling chamber rear wall 110 attached to the rear perimeter segment of baling chamber door frame 180 to the front of the attachment of the anterior end of baling chamber rear structural member 108 to the front perimeter segment of baling chamber anterior door frame 180.

Baling chamber front wall 104 comprises a vertically-oriented rectangular structure comprising an outer (front) surface, an inner (rear) surface, an upper longitudinal end, a lower longitudinal end, a posterior vertical end, and an anterior vertical end. The lower longitudinal end of baling chamber front wall 104 is attached to and in contact with baling chamber lower structural member 102, preferably along substantially the longitudinal length of baling chamber front wall 104. The upper longitudinal end of baling chamber front wall 104 preferably is in contact with top door 170 when top door 170 is closed substantially the longitudinal length of baling chamber front wall 104. Alternatively, the upper longitudinal end of baling chamber front end 104 is attached to the underside of baling chamber upper structural member 185. The central portion of the outer front surface of baling chamber front wall 104 is attached to and in contact with baling chamber front structural member 106, preferably substantially the longitudinal length of baling chamber front wall 104. The front surface of pusher block 140 is in substantial contact but not fixedly attached to the inner rear surface of baling chamber front wall 104. The anterior vertical end of baling chamber front wall 104 is attached to one or more perimeter segments of baling chamber anterior door frame 180, with such attachment preferably substantially the vertical height of baling chamber front wall 104. Posterior vertical end of baling chamber front wall 104 is preferably substantially not attached along its vertical height to any other structure, forming the front end of the substantially open posterior of baling chamber 100.

Baling chamber rear wall 110 comprises a vertically-oriented rectangular structure comprising an outer (rear) surface, an inner (front) surface, an upper longitudinal end, a lower longitudinal end, a posterior vertical end, and an anterior vertical end. The horizontal longitudinal lower end of baling chamber rear wall 110 is attached to and in contact with the rear longitudinal surface of lower structural member 102 along substantially the longitudinal length of baling chamber rear wall 110. The upper longitudinal end of baling chamber rear wall 110 preferably is in contact with top door 170 when top door 170 is closed substantially the longitudinal length of baling chamber rear wall 110. Alternatively, the upper longitudinal end of baling chamber rear wall 110 is attached to the underside of baling chamber upper structural member 185. The central portion of the outer rear surface of baling chamber rear wall 110 is attached to and in contact with baling chamber rear structural member 108, preferably substantially the longitudinal length of baling chamber rear wall 110. The rear surface of pusher block 140 is in substantial contact but not fixedly attached to the inner front surface of baling chamber rear wall 110. The anterior vertical end of baling chamber rear wall 110 is attached to one or more perimeter segments of baling chamber anterior door frame 180, with such attachment preferably substantially the vertical height of baling chamber rear wall 110. Posterior vertical end of baling chamber front wall 104 is preferably substantially not attached along its vertical height to any other structure, forming the rear end of the substantially open posterior of baling chamber 100.

The baling chamber rear wall 110 and baling chamber front wall 104 are laterally spaced apart and the baling chamber lower structural member 102 and baling chamber upper structural member 185 are vertically spaced apart. This spacing creates a hollow interior of baling chamber 100 with a substantially open posterior and a substantially open anterior.

The posterior of the upper longitudinal end of baling chamber rear wall 110 can be attached to the underside of the posterior lateral segment of baling chamber upper structural member 185 or alternatively not attached to the underside of baling chamber upper structural member 185 and positioned to the rear of posterior lateral segment of baling chamber upper structural member 185, with the posterior of the upper longitudinal end of baling chamber rear wall 110 flush with (at the same vertical position of) and attached to the posterior lateral segment of baling chamber upper structural member 185. The posterior of the upper longitudinal end of baling chamber front wall 104 can be attached to the underside of the posterior lateral segment of baling chamber upper structural member 185. Preferably, the upper longitudinal end of baling chamber front wall 104 is positioned to the rear of the front longitudinal segment of baling chamber upper structural member 185.

Baling chamber upper structural member 185 extends from the posterior to the anterior of baling chamber 100 and comprises a plurality of perimeter segments (anterior lateral segment, front longitudinal segment, posterior lateral segment, rear longitudinal segment) encompassing a substantially rectangular hollow interior, each segment having a topside and an underside. Anterior lateral segment of baling chamber upper structural member 185 attaches to the upper perimeter segment of baling chamber anterior door frame 180, with preferably such attachment occurring along the entire anterior lateral segment of baling chamber upper structural member 185. The posterior lateral segment of baling chamber upper structural member 185 comprises the upper lateral end of the substantially open posterior of baling chamber 100. Preferably, posterior lateral segment of baling chamber upper structural member 185 has one or more apertures.

Preferably, the upper longitudinal ends of baling chamber front wall 104 and baling chamber rear wall 110 are attached to the underside of one or more segments of baling chamber upper structural member 185. More preferably, the upper longitudinal ends of baling chamber front wall 104 and baling chamber rear wall 110 are attached to the underside of at least the front longitudinal segment and rear longitudinal segment of baling chamber upper structural member 185, respectively, substantially along the entire longitudinal length of walls 104 and 110. Alternatively, baling chamber front wall 104 can be positioned to the rear of the front longitudinal segment of baling chamber upper structural member 185 and the baling chamber rear wall 110 can be positioned to the front of rear longitudinal segment of baling chamber upper structural member 185. Moreover and alternatively, baling chamber rear wall 110 is positioned to the posterior of baling chamber upper structural member 185 anterior lateral segment and baling chamber front wall 104 is positioned to the posterior of baling chamber upper structural member 185 anterior lateral segment.

In an alternative preferred embodiment, baling chamber upper structural member 185 comprises perimeter segments (anterior lateral segment, front longitudinal segment, and a posterior lateral segment) comprising a substantially inverse L shape with no rear longitudinal segment. Preferably, the upper longitudinal end of baling chamber front wall 104 is attached to the underside of one or more segments of baling chamber upper structural member 185. Additionally, and preferably, the upper longitudinal end of baling chamber front wall 104 is attached to the underside of at least the front longitudinal segment of baling chamber upper structural member 185, with such attachment more preferably occurring substantially along the entire longitudinal length of wall 104. Alternatively, the baling chamber front wall 104 is positioned to the rear of the front longitudinal segment of baling chamber upper structural member 185. Moreover and alternatively, baling chamber rear wall 110 is positioned to the posterior of baling chamber upper structural member 185 anterior lateral segment and baling chamber front wall 104 is positioned to the posterior of baling chamber upper structural member 185 anterior lateral segment.

Preferably, along the longitudinal axis of baling chamber 100 are positioned a one or more upper front gussets 128, each such upper front gusset 128 having an anterior and a posterior face and an upper lateral end, a front vertical end, a lower lateral end, and a rear vertical end, such one or more upper front gussets 128 joining and extending between baling chamber upper structural member 185 and baling chamber front structural member 106, with the upper lateral end of each upper front gusset 128 attached to and in contact with the underside of the front longitudinal segment of baling chamber upper structural member 185 and the lower lateral end of each upper front gusset 128 attached to and in contact with baling chamber front structural member 106.

Preferably, along the longitudinal axis of baling chamber 100 are positioned one or more lower front gussets 126, each such lower front gusset 126 having an anterior and a posterior face and an upper lateral end, a front vertical end, a lower lateral end, and a rear vertical end, such one or more lower front gussets 126 joining and extending between baling chamber front structural member 106 and baling chamber lower structural member 102, with the upper lateral end of each lower front gusset 126 attached to and in contact with baling chamber front structural member 106 and the lower lateral end of each lower front gusset 126 attached to and in contact with the baling chamber lower structural member 102.

Preferably, along the longitudinal axis of baling chamber 100 are positioned one or more lower rear gussets 127, each such lower rear gusset 127 having an anterior and a posterior face and an upper lateral end, a front vertical end, a lower lateral end, and a rear vertical end, such one or more lower rear gussets 127 joining and extending between baling chamber rear structural member 108 and baling chamber lower structural member 102, with the upper lateral end of each lower rear gusset 127 attached to and in contact with baling chamber rear structural member 108 and the lower lateral end of each lower rear gusset 127 attached to and in contact with the baling chamber lower structural member 102.

In a preferred embodiment, one or more upper posterior gussets 189, each having at least a lower end, a posterior end, and an anterior end, and a front face and a rear face, are attached to the topside of baling chamber upper structural member, preferably the posterior lateral segment of baling chamber upper structural member 185, such upper posterior gussets 189 joining and baling chamber upper structural member 185 to posterior flange 187 with at least the lower end of each of the one or more upper posterior gusset 189 attached to baling chamber upper structural member 185 and with at least the anterior end of each of the one or more upper posterior gussets 189 attached to posterior flange 187. Upper posterior gussets 189 can be any one of multiple shapes of gussets known in the art, including triangular, square, rectangular, or trapezoidal.

In a preferred embodiment, one or more upper anterior gussets 184, each having at least a lower end, anterior end, and a posterior end and a front face and rear face, are attached to the topside of baling chamber upper structural member 185, preferably anterior lateral segment of baling chamber upper structural member 185, such upper anterior gussets 184 joining baling chamber upper structural member 185 to anterior flange 182, with at least the lower end of each of the one of the one or more upper anterior gussets 184 attached to baling chamber upper structural member 185, and with at least the posterior end of each of the one or more upper anterior gussets 184 attached to anterior flange 182. More preferably, one or more upper anterior gussets 184 is attached to the baling chamber upper structural member 185 and the baling chamber anterior door frame 180, with one or more of these such upper anterior gussets 184 extending longitudinally from the baling chamber anterior door frame 180 to the anterior flange 182, with the posterior end of such upper anterior gussets 184 attached to anterior flange 182, the anterior end of such upper anterior gussets 184 attached to baling chamber anterior door frame 180, and the lower end of such upper anterior gussets attached to baling chamber upper structural member 185. Upper anterior gussets 184 may take any one of multiple shapes of gussets known in the art, including triangular, square, rectangular, or trapezoidal.

Attached to baling chamber upper structural member 185, preferably the topside of the front longitudinal segment of baling chamber upper structural member 185, is safety guard 190 which extends vertically upward from baling chamber upper structural member 185 and with an anterior end, a posterior end, a lower end, and an upper end, and a front face and a rear face. The anterior end and posterior end of safety guard 190 can be (i) attached to the posterior of anterior flange 182 and the anterior of posterior flange 187, respectively, (ii) abut but not be attached to either the posterior of anterior flange 182 or the anterior of posterior flange 187, respectively, or (iii) spaced apart longitudinally from the anterior flange 182 and posterior flange 187, respectively. In a preferred embodiment, attached to the front face of safety guard 190 is one or more safety guard gussets 193 (see FIG. 2) each with at least a rear end, front end, and lower end and an anterior face and a posterior face, with the rear end of each of the one or more safety guard gussets 193 attached to the front face of safety guard 190 and the lower end of each of the one or more safety guard gussets 193 attached to the baling chamber upper structural member 185, preferably the topside of the front longitudinal segment of baling chamber upper structural member 185. In an alternative embodiment, the front face of safety guard 190 is substantially vertical and perpendicular to baling chamber upper structural member 185 (see FIG. 9).

Baling chamber upper door 170 comprises a structure with an anterior and a posterior lateral end, a front and a rear longitudinal end, and a topside and an underside. The rear longitudinal end of baling chamber upper door 170 is hingedly connected to the baling chamber rear wall 110 via hinge 177. In a preferred embodiment, hinge 177 comprises a plurality of spaced-apart aligned, co-axial cylindrical hinge knuckles 143 and 144 on each of the rear longitudinal end of baling chamber upper door 170 (top door hinge knuckles 144) and the upper longitudinal end of baling chamber rear wall 110 (rear wall hinge knuckles 143) through which a hinge pin is passed. Specifically, formed on the rear longitudinal end of baling chamber upper door 170 are a plurality of spaced-apart top door hinge knuckles 144 having a substantially cylindrical shape. Formed at the rear of the upper longitudinal end of baling chamber rear wall 110 are a plurality of spaced-apart rear wall hinge knuckles 143 having a substantially cylindrical shape and that are aligned and co-axial with the plurality of top door hinge knuckles 144. The top door hinge knuckles 144 and rear wall knuckles 143 have approximately the same inner and outer diameter. The top door and rear wall hinge knuckles 144 and 143 are longitudinally spaced so that the aligned hinge knuckles form an alternating pattern of hinge knuckles (top door hinge knuckle 144, rear door hinge knuckle 143, top door hinge knuckle, 144). A hinge pin is passed through the plurality of hinge knuckles 143 and 144. Positioned at the rear of each of anterior flange 182 and posterior flange 187 is an aperture (anterior flange aperture 183 and posterior flange aperture 188) through which the anterior end and posterior end of the hinge pin is passed and secured, respectively.

In a preferred embodiment one or more of top door knuckles 144 has attached to the front of each such knuckle 144 hinge arm 194, with the rear longitudinal end of each such top door knuckle hinge arm 194. The underside of each hinge arm 194 is attached to the topside of top door 170. Each of the one or more hinge arms 194 extend laterally from top door hinge knuckle 144 toward the front of baling chamber 100, with the front longitudinal end of each such hinge arm 194 attached to the underside of top door front brace 195. Preferably, the topside of the front of one or more hinge arm 194 is attached to the underside of top door front brace 195.

In a preferred embodiment, positioned proximal to each of the anterior and posterior lateral ends of top door 170 is anterior top door arm 174 and posterior top door arm 172, respectively. The underside of anterior top door arm 174 and posterior top door arm 172 is attached to the topside of top door 170. Positioned at the rear end of each of anterior top door arm 174 and posterior top door arm 172 is anterior door arm rear projection 175 and posterior door arm rear projection 173, respectively. Preferably, each of anterior door arm rear projection 175 and posterior door arm rear projection 173 has an aperture substantially in the center of each such projection 173 and 175. In a preferred embodiment, top door front brace 195 extends longitudinally between anterior top door arm 174 and posterior top door arm 172, with the anterior end of top door front brace 195 attached to the posterior of anterior top door arm 174 at the front of anterior top door arm 174 and the posterior end of top door front brace 195 attached to the anterior of posterior top door arm 172 at the front of posterior top door arm 172. Moreover, and in a preferred embodiment, top door rear brace 176 extends longitudinally between anterior top door arm 174 and posterior top door arm 172, with the anterior end of top door rear brace 176 attached to the posterior of anterior top door arm 174 at the rear of anterior top door arm 174 at a lateral position to the front of anterior door arm projection 175 and the posterior end of top door rear brace 176 attached to the anterior of posterior top door arm 172 at the rear of posterior top door arm 172 at a lateral position to the front of posterior door arm projection 173. Preferably, top door rear brace 176 is vertically positioned above hinge 177.

In a preferred embodiment, the underside of anterior top door arm 174 is also attached to the topside of the most anterior top door hinge arm 194 which extends from the most anterior top door hinge knuckle. In a preferred embodiment, the underside of posterior top door arm 172 is also attached to the topside of the most posterior top door hinge arm 194 which extends from the most posterior top door hinge knuckle.

With respect to FIGS. 2-4, 7-9, 11 and 14-16 and in a preferred embodiment, anterior flange 182 extends vertically downward to and attaches to one or more of the upper end of baling chamber front structural member 106 and the upper end of baling chamber rear structural member 110, with anterior flange 182 extending laterally and attaching to one or more of the upper end of baling chamber front structural member 106 at the anterior front of baling chamber 100 and the upper end of baling chamber rear structural member 110 at the anterior rear of baling chamber 100. In a preferred embodiment, posterior flange 187 extends vertically downward to and attaches to one or more of the upper end of baling chamber front structural member 106 and the upper end of baling chamber rear structural member 110, with posterior flange 187 extending laterally and attaching to one or more of the upper end of baling chamber front structural member 106 at the posterior front of baling chamber 100 and the upper end of baling chamber rear structural member 110 at the posterior rear of baling chamber 100.

The top door 170 is movable manually or, preferably, hydraulically in accordance with operation of the modular baler 1 as discussed below, preferably with top door 170 anterior end in contact with upper structural member 185 anterior lateral segment, top door 170 posterior end in contact with baling chamber upper structural member 185 posterior lateral segment, top door 170 front end in contact with baling chamber front wall 104, and top door 170 rear end is in contact with baling chamber rear wall 110 when top door 170 is closed. Moreover, in addition to preferable hydraulic closure, top door 170 is preferably locked shut using any one of many methods known in the art, including but not limited to manually, hydraulically, electrically, or electronically.

In a preferred embodiment, locking handle 192 is attached to the topside of top door 170 or a structure attached to the topside of top door 170 selected from the group comprising a top door knuckle hinge arm 194 or top door front brace 195. Preferably, this attachment of locking handle 192 comprises a hinged attachment to allow for locking handle 192 to be manipulated to be vertically raised and lowered, with (i) lowering locking handle 192 comprising displacing the upper portion of locking handle 192 downward toward the posterior of baling chamber 100 to unlock top door 170 and (ii) raising locking handle 192 comprising displacing the upper portion of locking handle 192 upward toward the anterior of baling chamber 100 to lock top door 170.

Additionally, and preferably, locking handle 192 comprises a substantially hollow structure with an open upper end and a lower end. The open lower end of locking handle 192 is removably placed over locking handle mate structure (not numbered or depicted in the figures) which has a cross sectional area approximating but less than the cross-sectional area of the open lower end of locking handle 192 to allow for a tight or transition fit of open lower end of locking handle 192 over locking handle mate structure. The locking handle mate structure is attached to the topside of top door 170 or a structure attached to the topside of top door 170 selected from the group comprising a top door knuckle hinge aim 194 or top door front brace 195. Locking handle pin (not pictured in figures or numbered) comprises a structure with a cross sectional area approximating the cross sectional area of locking handle mate structure and is inserted into locking handle 192 when it is in a substantially vertical position so as to close top door 170, with the lower end of locking handle pin fitting tightly into locking handle mating structure to maintain locking handle 192 in a substantially vertical position to prevent locking handle 192 to be vertically lowered to unlock top door 170. To unlock top door 170, locking handle pin is removed from locking handle 192, thereby disengaging the lower end of locking handle pin from locking handle mating structure, and locking handle 192 is vertically lowered.

Figure 18:
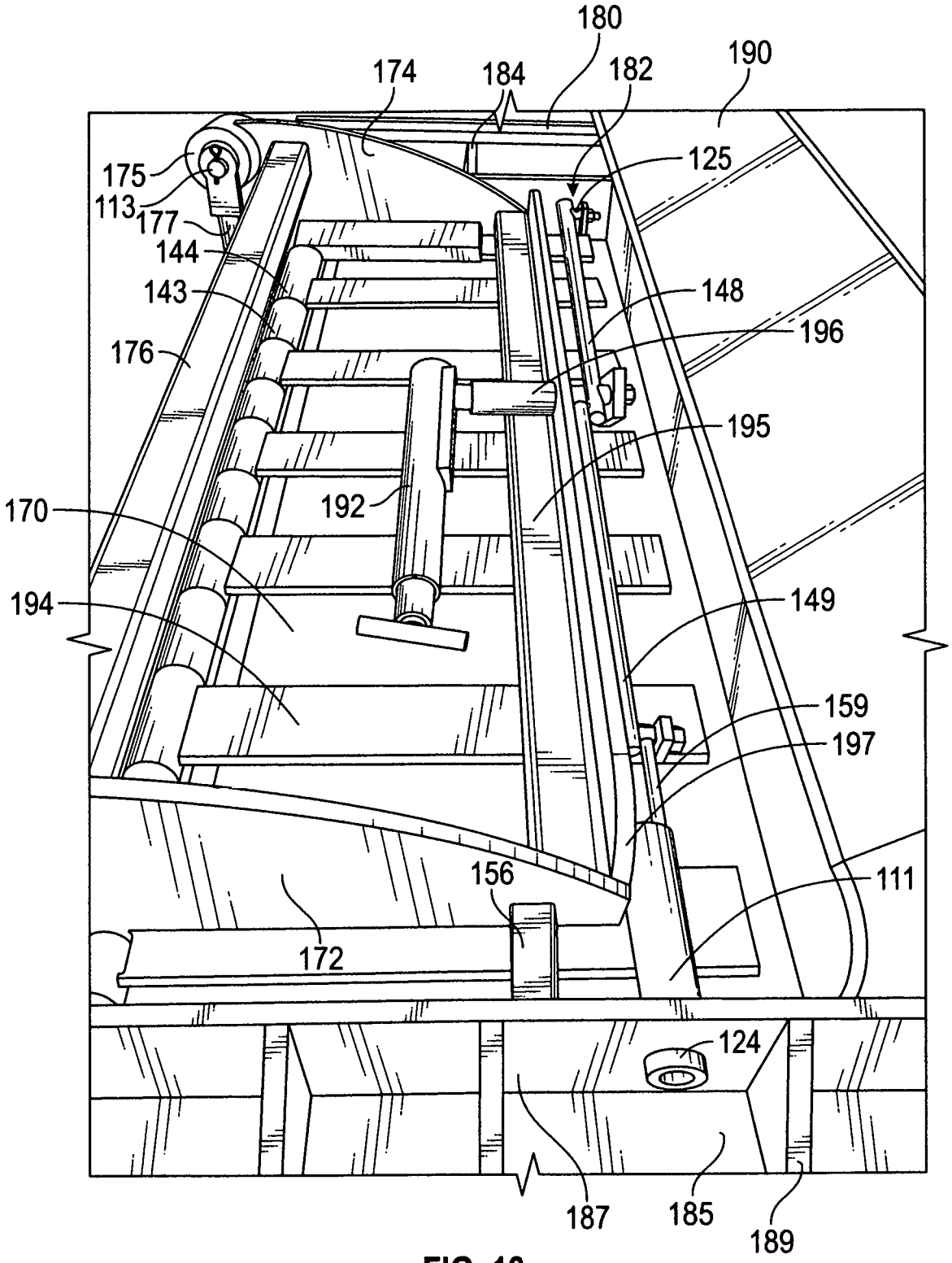
FIG. 18 is a perspective view of the baling chamber top door of an embodiment of the present invention.
Figure 19:
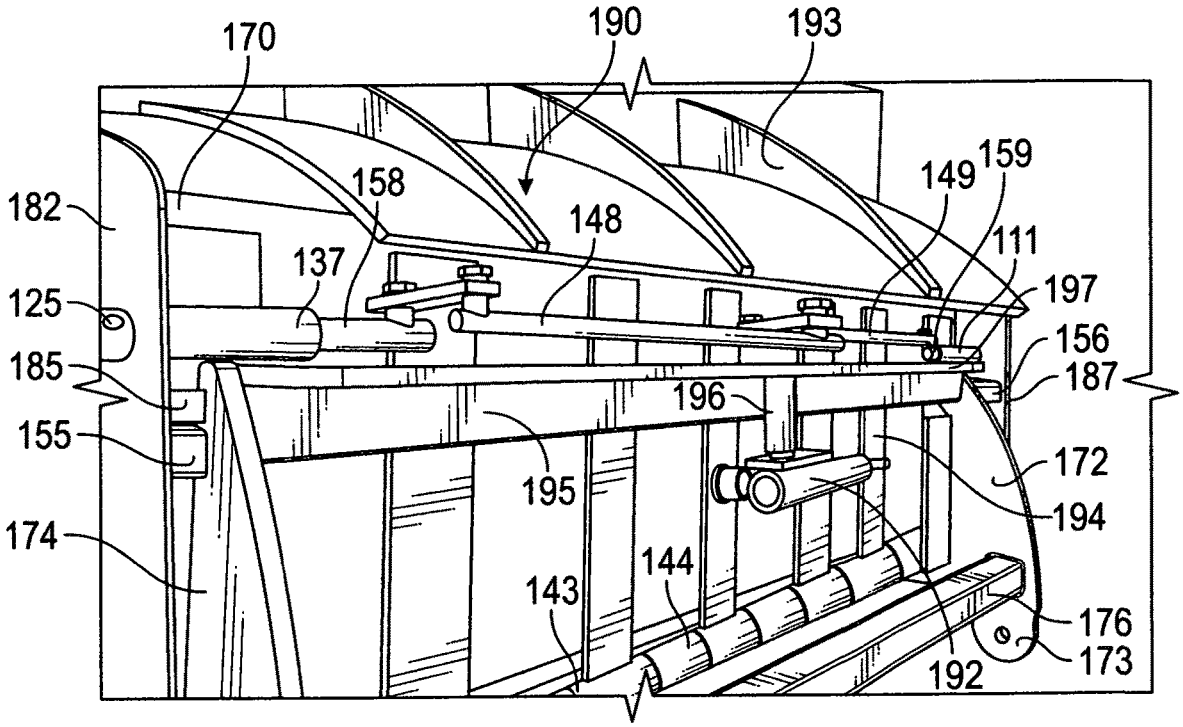
FIG. 19 is an overview of the baling chamber top door of an embodiment of the present invention.

Preferably, locking handle 192 is attached to top door front brace 195. More preferably, locking handle 192 is attached to top door front brace 195 via locking handle connecting arm 196 (see FIGS. 7, and 18-19), with the rear end of locking handle connecting arm 196 attached to the lower end of locking handle 192 and the front end of locking handle connecting arm 196 attached to top door front brace 195.

More preferably, the front end of locking handle connecting arm 196 is attached to front longitudinal beam 197 which is attached, at one or more attachment points extending along the longitudinal length of front longitudinal beam 197, to top door front brace 195. Additionally and preferably, front longitudinal beam 197 extends longitudinally from the anterior to the posterior of top door front brace 195.

In a preferred embodiment, locking handle connecting arm 196 comprises an internal rotatable cylinder with a front end and a rear end and an external fixed cylinder with an open front end and an open rear end, with the internal cylinder rotatable within external cylinder and extending through the front and rear ends of external cylinder. The rear end of the internal cylinder of locking handle connecting arm 196 extends from the rear end of external cylinder and is attached to locking handle 192. The external cylinder of locking handle connecting arm 196 is attached to top door front brace 195. More preferably, the external cylinder of locking handle connecting arm 196 is attached to front longitudinal beam 197 that is attached to top door front brace 195. Internal cylinder of locking handle connecting arm 196 extends through the open front end of external cylinder. Preferably, front longitudinal beam 197 has an aperture that coincides in longitudinal position with locking handle connecting arm 196, the external cylinder of locking handle connecting arm 196 is attached to the front longitudinal beam 197 and the internal cylinder of locking handle connecting arm 196 extends out of the open front end of the external cylinder of locking handle connecting arm 196 and through the aperture on front longitudinal beam 197.

In a preferred embodiment, the raising of locking handle 192 causes the attached internal cylinder of locking handle connecting arm 196 to rotate which then causes the rotation of a plurality of structures to extend toward the anterior and posterior of baling chamber 100 and through apertures on the anterior and posterior flanges 182 and 187, respectively, to thereby lock top door 170 shut. To that end, attached, either directly or indirectly via a separate structure, to locking handle connecting arm 196 is anterior locking rod 148 with anterior end and a posterior end and posterior locking rod 149 with an anterior end and a posterior end, with the posterior end of anterior locking rod 148 and the anterior end of posterior locking rod 149 attached to locking handle connecting arm 196. The anterior locking rod 148 extends longitudinally toward the anterior of baling chamber 100 and the front of anterior flange 182 and the posterior locking rod 149 extends longitudinally toward the posterior of baling chamber 100 toward the front of posterior flange 187. Each of locking rods 148 and 149 are longitudinally displaceable by manipulation of locking handle 192 causing movement of locking handle connecting arm 196 resulting in anterior locking rod 148 being displaced longitudinally toward the anterior of baling chamber 100 and posterior locking rod 149 being displaced longitudinally toward the posterior of baling chamber 100.

More preferably, locking handle connecting arm 196 is comprised of an internal and external cylinder as described above, and attached, either directly or indirectly via a separate structure, to the front end of internal cylinder of locking handle connecting arm 196 is anterior locking rod 148 and posterior locking log arm 149, with the posterior end of anterior locking rod 148 and the anterior end of posterior locking rod 149 attached, either directly or indirectly via a separate structure, to the front end of the internal cylinder of locking handle connecting arm 196. In one preferred embodiment, the attachment of the locking rods 148 and 149 to the front end of internal cylinder of locking handle connecting arm 196 can comprise a direct connection, wherein the posterior end of anterior locking rod 148 is attached to the front end of the internal cylinder of locking handle connecting arm 196 and the anterior end of posterior locking rod 149 is attached to the front end of the internal cylinder of locking handle connecting arm 196, or an indirect connection, wherein the posterior end of anterior locking rod 148 and the anterior end of posterior locking rod 149 are each attached to locking handle-locking rod attachment plate and the locking handle-locking rod attachment plate is attached to the front end of the internal cylinder of locking handle connecting arm 196.

In this preferred embodiment, top door 170 is manually locked by raising locking handle 192 toward the anterior of baling chamber 100 to the vertical upright position, such that locking handle 192 is substantially perpendicular to top door 170 when top door 170 is closed, which causes counterclockwise rotation of internal cylinder of locking handle connecting arm 196 within the external fixed cylinder of locking handle connecting arm 196. The rotation of internal cylinder of locking handle connecting arm 196 causes displacement of anterior locking rod 148 toward the anterior of baling chamber 100 and posterior locking rod 149 toward the posterior of baling chamber 100. Attached to the anterior end of anterior locking rod 148 is anterior locking lug 158 with an anterior end and a posterior end and attached to the posterior end of posterior locking rod 149 is posterior locking lug 159 with an anterior end and a posterior end. The attachment of locking rods 148 and 149 to locking lugs 158 and 159 can be a direct attachment, wherein the anterior end of anterior locking rod 148 is attached directly to the posterior end of anterior locking lug 158 and the posterior end of posterior locking rod 149 is attached directly to the anterior of posterior locking lug 149, or an indirect attachment, with the anterior end of anterior locking rod 148 attached to anterior locking rod-anterior locking lug attachment plate (not figured or numbered) and the posterior end of anterior locking lug 158 attached to anterior locking rod-anterior locking lug attachment plate and the posterior end of posterior locking rod 149 attached to posterior locking rod-posterior locking lug attachment plate and the anterior end of posterior locking lug 159 attached to posterior locking rod-posterior locking lug attachment plate. Preferably, the posterior end of anterior locking lug 158 is attached to anterior locking rod-anterior locking lug attachment plate and the anterior end of posterior locking lug 159 is attached to posterior locking rod-posterior locking lug attachment plate. In a preferred embodiment, rotation of internal cylinder of locking handle connecting arm 196 longitudinally displaces anterior locking rod 148 toward the anterior of baling chamber 100, which in turn causes longitudinal displacement of anterior locking lug 158 to the anterior of baling chamber 100, with the anterior end of anterior locking lug 158 extending through aperture 125 at the front of anterior flange 182. Moreover, in a preferred embodiment, rotation of internal cylinder of locking handle connecting arm 196 longitudinally displaces posterior locking rod 149 toward the posterior of baling chamber 100, which in turn causes longitudinal displacement of posterior lug 159 to the posterior of baling chamber 100, with the posterior end of posterior lug 159 extending through aperture 124 at the front end of posterior flange 187. In a preferred embodiment where locking rods 148 and 149 and locking lugs 158 and 159 are attached to each other via a locking rod-locking lug attachment plate, displacement of locking rods 148 and 149 causes displacement of locking rod-locking log attachment plates, preferably rotation or pivoting of the plates, downward and toward top door 170 during locking of top door 170. Moreover, and in a preferred embodiment, when top door 170 is locked, anterior locking lug 158 extends through the posterior end and anterior end of anterior locking lug shell 137 and through aperture 125 at the front of anterior flange 182, with anterior locking lug shell 137 comprising an open ended structure (open at the anterior end and posterior end of anterior locking lug shell 137) attached to the topside of the front end of the most anterior top door hinge arm 194 and substantially concentric with aperture 125 at the front of anterior flange 182. Moreover, and in a preferred embodiment, when top door 170 is locked, posterior locking lug 159 extends through the anterior end and posterior end of posterior locking lug shell 111 and through aperture 124 at the front of posterior flange 187, with posterior locking lug shell 111 comprising an open ended structure (open at the anterior end and posterior end of posterior locking lug shell 111) attached to the topside of the front end of the most posterior top door hinge arm 194 and substantially concentric with aperture 124 at the front of anterior flange 187.

In a preferred embodiment, attached to anterior top door arm 174 and posterior top door arm 172 is anterior top door stop 155 and posterior top door stop 156, respectively, each stop having a posterior end, an anterior end, a front end, and a rear end, and a topside and underside. The posterior end of anterior top door stop 155 is attached to anterior top door arm 174. The underside of anterior top door stop 155 at the anterior end of anterior top door stop 155 abuts the topside of upper structural member 185 when top door 170 is closed, with anterior top door stop 155 extending over the juncture of top door 170 with upper structural member 185 resulting from the underside of anterior lateral end of top door 170 abutting the topside of anterior lateral segment of upper structural member 185. More preferably, the anterior end of anterior top door stop 155 abuts anterior flange 182 when top door 170 is closed. Additionally, and more preferably, the underside of anterior top door stop 155 at the posterior end is attached to the most anterior top door knuckle hinge arm 194.

In a preferred embodiment, the anterior end of posterior top door stop 156 is attached to posterior top door arm 172. The underside of posterior top door stop 156 at the posterior end of posterior top door stop 156 abuts the topside of upper structural member 185 when top door 170 is closed, with posterior top door stop 156 extending over the juncture of top door 170 with upper structural member 185 resulting from the underside of posterior lateral end of top door 170 abutting the topside of posterior lateral segment of upper structural member 185. More preferably, the posterior end of posterior top door stop 156 abuts posterior flange 187 when top door 170 is closed. Additionally, and more preferably, the underside of posterior top door stop 156 at the anterior end is attached to the most posterior knuckle hinge arm 194.

Positioned in the open (hollow) interior of baling chamber 100 is pusher block 140. Pusher block 140 is sized to be longitudinally displaceable and slidably fit in the open (hollow) interior between baling chamber front wall 104 and baling chamber rear wall 110. Preferably, the width (lateral dimension) of pusher block 140 approximates but is less than the lateral distance separating baling chamber front wall 104 from baling chamber rear wall 110.

Pusher block 140 comprises (i) pusher block anterior surface having an upper end, a lower end, a front end, and a rear end, (ii) pusher block lower surface with posterior end, anterior end, front end, and rear end, (iii) pusher block front surface with an upper end, anterior end, lower end, and posterior end, (iv) pusher block rear surface with an upper end, anterior end, lower end, and posterior end, (v) pusher block upper surface with an anterior end, front end, posterior end, and rear end, and (vi) a substantially open posterior surface bounded by the posterior ends of pusher block upper surface, pusher block front surface, pusher block rear surface, and pusher block lower surface. Preferably, (i) pusher block anterior surface extends vertically from upper end to lower end and laterally from front end to rear end, (ii) pusher block lower surface extends longitudinally from anterior end to posterior end and laterally from front end to rear end, (iii) pusher block upper surface extends longitudinally anterior end to posterior end and laterally from front end to lower end, (iv) pusher block rear surface extends vertically from upper end to lower end and longitudinally from anterior end to posterior end, and (v) pusher block front surface extends vertically from upper end to lower end and longitudinally from anterior end to posterior end. Pusher block 140 upper surface, rear surface, front surface, and lower surface comprise pusher block 140 surfaces.

Additionally and preferably, (i) pusher block upper surface front end is coterminous with pusher block front surface upper end, (ii) pusher block upper surface rear end is coterminous with pusher block rear surface upper end, (iii) pusher block lower surface front end is coterminous with pusher block front surface lower end, (iv) pusher block lower surface rear end is coterminous with pusher block rear surface lower end, (v) pusher block anterior surface front end is coterminous with pusher block front surface anterior end, (vi) pusher block anterior surface rear end is coterminous with pusher block rear surface anterior end, (vii) pusher block upper surface anterior end is coterminous with pusher block anterior surface upper end, and (viii) pusher block anterior surface lower end is coterminous with pusher block lower surface anterior end.

In a preferred embodiment, positioned in the interior of pusher block 140 is pusher block hub 142 and one or more upper joints and one or more lower joints, each joint extending from the juncture of two pusher block 140 surfaces to pusher block hub 142. Preferably, positioned in the interior of pusher block 140 are two upper joints and two lower joints. Pusher block hub 142 may take any one of multiple known shapes in the art, including substantially rectangular polygonal or, more preferably, substantially cylindrical.

In a preferred embodiment where pusher block hub 142 has a substantially rectangular polygonal shape, pusher block hub 142 comprises (i) an upper surface with aperture 145 and extending longitudinally from pusher block anterior surface to the substantially open posterior of pusher block 140 and having an anterior end, posterior end, front end, and rear end, (ii) a lower surface extending longitudinally from pusher block anterior surface to the substantially open posterior of pusher block 140 and having an anterior end, posterior end, front end, and rear end, (iii) a front surface extending vertically from pusher block hub 142 upper surface to pusher block hub 142 lower surface and longitudinally from pusher block anterior surface to the substantially open posterior of pusher block 140 and having an upper end, anterior end, posterior end, and lower end, (iv) a rear surface extending vertically from pusher block hub 142 upper surface to pusher block hub 142 lower surface and longitudinally from pusher block anterior surface to the substantially open posterior of pusher block 140 and having an upper end, lower end, anterior end, and posterior end, (v) a substantially open (hollow) posterior bounded by pusher block hub 142 upper surface posterior end, pusher block hub 142 front surface posterior end, pusher block hub 142 lower surface posterior end, and pusher block hub 142 rear surface posterior end, and (vi) an anterior surface of pusher block hub 142. In a preferred embodiment of the present invention, the anterior surface of pusher block hub 142 is a portion of pusher block 140 anterior surface.

Additionally and preferably, (i) pusher block hub upper surface front end is coterminous with pusher block hub front surface upper end, (ii) pusher block hub upper surface rear end is coterminous with pusher block hub rear surface upper end, (iii) pusher block hub lower surface front end is coterminous with pusher block hub front surface lower end, (iv) pusher block hub lower surface rear end is coterminous with pusher block hub rear surface lower end, (v) pusher block hub anterior surface front end is coterminous with pusher block hub front surface anterior end, (vi) pusher block hub anterior surface rear end is coterminous with pusher block hub rear surface anterior end, (vii) pusher block hub upper surface anterior end is coterminous with pusher block hub anterior surface upper end, and (viii) pusher block hub anterior surface lower end is coterminous with pusher block hub lower surface anterior end.

In a preferred embodiment, pusher block 140 has two upper joints (front and rear) and two lower joints (front and rear). Upper front joint has an anterior end, upper end, posterior end, and lower end and extends from pusher block hub 142 upper surface-front surface juncture (pusher block hub 142 upper surface front end-front surface upper end) to pusher block 140 upper surface-front surface juncture (pusher block 140 upper surface front end-front surface upper end). Preferably, the posterior end of upper front joint coincides with the substantially open posterior o pusher block 140 and the anterior end of upper front joint coincides with pusher block 140 anterior surface. More preferably, upper front joint upper end coincides with the pusher block 140 upper surface-front surface juncture (pusher block 140 upper surface front end-front surface upper end) and the upper front joint lower end coincides with the pusher block hub 142 upper surface-front surface juncture (pusher block hub 142 upper surface front end-front surface upper end).

Upper rear joint has an anterior end, upper end, lower end, and posterior end and extends from pusher block hub 142 upper surface-rear surface juncture (pusher block hub 142 upper surface rear end-rear surface upper end) to pusher block 140 upper surface-rear surface juncture (pusher block 140 upper surface rear end-rear surface upper end). Preferably, the posterior end of upper rear joint coincides with the substantially open posterior of pusher block 140 and the anterior end of upper rear joint coincides with pusher block 140 anterior surface. More preferably, upper rear joint upper end coincides with the pusher block 140 upper surface-rear surface juncture (pusher block 140 upper surface rear end-rear surface upper end) and upper rear joint lower end coincides with the pusher block hub 142 upper surface-rear surface juncture (pusher block hub 142 upper surface rear end-rear surface upper end).

Lower front joint has an anterior end, upper end, lower end, and posterior end and extends from pusher block hub 142 front surface-lower surface juncture (pusher block hub 142 front surface lower end-lower surface front end) to pusher block 140 lower surface-front surface juncture (pusher block 140 front surface lower end-lower surface front end). Preferably, the posterior end of lower front joint coincides with the substantially open posterior of pusher block 140 and the anterior end of upper rear joint coincides with pusher block 140 anterior surface. More preferably, lower front joint upper end coincides with the pusher block hub 142 front surface-lower surface juncture (pusher block hub 142 front surface lower end-lower surface front end) and lower front joint lower end coincides with pusher block 140 front surface-lower surface juncture (pusher block 140 front surface lower end-lower surface front end).

Lower rear joint has an anterior end, upper end, lower end, and posterior end and extends from pusher block hub 142 rear surface-lower surface juncture (pusher block hub 142 rear surface lower end-lower surface rear end) to pusher block 140 lower surface-rear surface juncture (pusher block 140 rear surface lower end-lower surface rear end). Preferably, the posterior end of lower rear joint coincides with the substantially open posterior of pusher block 140 and the anterior end of lower rear joint coincides with pusher block 140 anterior surface. More preferably, lower rear joint upper end coincides with the pusher block hub 142 rear surface-lower surface juncture (pusher block hub 142 rear surface lower end-lower surface rear end) and lower rear joint lower end coincides with pusher block 140 rear surface-lower surface juncture (pusher block 140 rear surface lower end-lower surface rear end).

Preferably, the lateral distance separating pusher block hub 142 front surface from rear surface and the lateral distance separating pusher block hub 142 upper surface from lower surface each approximate but are more than the diameter of cylinder rod 216 of cylinder 213 of cylinder frame 200 to allow for a secure fitting of cylinder rod 216 within pusher block hub 142. Preferably, the lateral distance separating pusher block hub 142 front surface from rear surface and the lateral distance separating pusher block hub 142 upper surface from lower surface are substantially similar, more preferably equal.

In an alternative preferred embodiment of the present invention, pusher block hub 142 is a substantially cylindrical structure with an open posterior at the posterior of pusher block 140 and a closed anterior, preferably coinciding with pusher block 140 anterior surface, with the lower end of upper front joint, lower end of upper rear joint, upper end of lower front joint, and upper end of lower rear joint preferably extending along the outer (cylindrical) surface of pusher block hub 142, more preferably such ends extending along the entire longitudinal length of pusher block hub 142 from the posterior of pusher block hub 142 to pusher block 140 anterior surface. Additionally and more preferably, the posterior of pusher block hub 142 coincides with the substantially open posterior of pusher block 140 and comprises a substantially circular structure bounding an open (hollow) interior. Moreover, and more preferably, the anterior surface of pusher block hub 142 coincides with a substantially circular cross-sectional portion of pusher block 140 anterior surface. In a preferred embodiment, the inner diameter of pusher block hub 142 approximates but is but is more than the diameter of cylinder rod 216 of cylinder 213 of cylinder frame 200 to allow for a secure fitting of cylinder rod 216 within pusher block hub 142.

The substantially open anterior of baling chamber 100 is closed by baling chamber anterior door comprised of anterior front door panel 150 and anterior rear door panel 160, each panel 150 and 160 having an upper end, lower end, front end, and lower end, and an inner (posterior) surface proximal the anterior door frame 180 when baling chamber anterior door is closed and an outer (anterior) surface distal from anterior door frame 180 when baling chamber anterior door is closed. Preferably, anterior rear door panel 160 comprises a plurality of vertically spaced apart anterior rear door panel horizontal structural members 167, each structural member 167 having a posterior end, an upper end, a lower end, a front end, a rear end, an outer (anterior) surface and an inner (posterior) surface, with the anterior surfaces of the structural members 167 forming a discontinuous anterior surface of rear door panel 160. As indicated, each such anterior rear door panel horizontal structural member 167 is spaced apart from any adjacent structural member 167. Preferably, a plurality of vertically spaced-apart ridges 157 is formed on the outer (anterior) surface of anterior front door panel 150 and protrude therefrom, with each of the plurality of ridges 157 spaced apart vertically and positioned to coincide with the open space separating each anterior rear door panel horizontal structural member 167. More preferably, positioned on the outer (anterior) surface of anterior rear door panel 160 is anterior rear door panel vertical member 166, which preferably extends vertically from the uppermost horizontal structural member 167 downward to the lowermost horizontal structural member 167. Preferably, a portion of the outer (anterior) surface of each horizontal structural member 167 is attached to the underside of anterior rear door panel vertical member 166.

Positioned on the upper end of each door panel 150 and 160 is handle, with anterior front door panel handle 152 positioned on anterior front door panel 150 and anterior rear door panel handle 162 positioned on anterior rear door panel 162. Preferably, each handle 152 and 162 is comprised of a horizontal member with two ends and two vertical members, each vertical member attached to an end of the horizontal member.

The front end of anterior front door panel 150 and the rear end of anterior rear door panel 160 is hingedly attached to anterior door frame 180. In a preferred embodiment, the front end of anterior front door panel 150 is hingedly connected to the anterior front of anterior door frame 180 via anterior front door panel hinge 154 and the rear end of anterior rear door panel 160 is hingedly connected to the anterior rear of anterior door frame 180 via anterior rear door panel hinge 164. Each hinge 154 and 164 can be formed using any one of many known hinges in the prior art. In a preferred embodiment, each hinge 154 and 164 comprises a plurality of spaced-apart aligned, co-axial substantially cylindrical hinge knuckles on the front end of anterior front door panel 150 and rear end of anterior rear door panel 160 at the anterior front and anterior rear of anterior door frame 180, respectively. Formed at one or more of the perimeter segments of anterior door frame 180, preferably at least the front segment of anterior door frame 180, are a plurality of spaced-apart door frame hinge knuckles having a substantially cylindrical shape and that are aligned and co-axial with the plurality of anterior front door panel 150 hinge knuckles. Formed at one or more of the perimeter segments of anterior door frame 180, preferably at least the rear segment of anterior door frame 180, are a plurality of spaced-apart door frame hinge knuckles having a substantially cylindrical shape and that are aligned and co-axial with the plurality of anterior rear door panel 160 hinge knuckles. The door panel and door frame hinge knuckles have approximately the same inner and outer diameters. More preferably, the door panel hinge knuckles and door frame hinge knuckles at hinges 154 and 164 are longitudinally spaced so that the aligned hinge knuckles form an alternating pattern of hinge knuckles (door panel hinge knuckle, door frame hinge knuckle, door panel hinge knuckle). To secure the hinge knuckles, a door panel hinge pin is passed through the plurality of hinge knuckles and secured in position.

Door panels 150 and 160 comprising baling chamber anterior door can be secured using any one of many door closures known in the art. In a preferred embodiment, baling chamber anterior door is closed using anterior door closure device 161 that is attached to one of door panels 150 and 160. In a preferred embodiment, anterior door closure device 161 comprises a vertical member comprising an upper section, a middle section, and a lower section. Attached to a section of anterior door closure device 161 is handle 165, preferably attached to vertical member middle section. One or more of the upper section and lower section of vertical member has hook 168 [shown on FIG. 3] which extends upward and/or downward from vertical member upper section and/or vertical member lower section, respectively. More preferably, each of upper section and lower section of vertical member has such a hook 168. Each hook 168 mates with a locking lug 169 attached to and protruding from the anterior of anterior door frame 180. More preferably, anterior door closure upper hook **168*a*, positioned at anterior door closure device 161 vertical member upper section, mates with anterior door frame upper locking lug 169*a* and anterior door closure lower hook 168*b*, positioned at anterior door closure device 161 vertical member lower section, mates with anterior door frame lower locking lug 169*b***.

The one or more anterior locking lugs 169 is or are attached to the anterior of anterior door frame 180, preferably on the front perimeter segment of anterior door frame 180. In a preferred embodiment and with reference to FIG. 14, upper anterior locking lug **169*a* is attached to the upper portion of front perimeter segment of anterior door frame 180 and lower anterior locking lug 169*b* is attached to the lower portion of front perimeter segment of anterior door frame 180**.

Baling chamber anterior door is closed by positioning each panel 150 and 160 over the substantially hollow interior bounded by the perimeter segments of anterior door frame 180, handle 165 is displaced, causing displacement of the one or more hooks 168 on anterior door closure device 161 to a position to allow for such one or more hooks 168 to mate with the one or more anterior door frame locking lugs 169. More preferably, the vertical member of anterior door closure device 161 is rotatable, with displacement of handle 165 causing rotation of vertical member of anterior door closure device 161 which in turn causes rotation of the one or more hooks 168 on the ends of vertical member of anterior door closure device 161 into a position to mate with the one or more anterior door frame locking lugs 169.

In a preferred embodiment, when anterior door frame is closed, one of front and rear panels 150 and 160 is an interior panel and the other is an exterior panel, with the panels secured in a nested arrangement, with anterior door closure device 161 positioned on the exterior panel, with the interior panel closed first and the exterior panel closed second. More preferably, the inner (posterior) surface of the interior panel is in contact with the anterior of anterior door frame 180, with at least a portion of the outer (anterior) surface of the interior panel in contact with the posterior of the exterior panel. Additionally and more preferably, at least a portion of the outer (anterior) surface of the interior panel is not covered by the exterior panel. In a preferred embodiment, the interior panel is the anterior front door panel 150 and the exterior panel is the anterior rear door panel 160. More preferably, anterior door closure device 161 is positioned on the rear panel 160 and rear panel 160 is the exterior panel when baling chamber anterior door is closed.

As indicated above, top door 170 of baling chamber 100 is preferably hydraulically moved with means for hydraulically moving baling chamber 100 positioned at the rear of baling chamber 100, more preferably such means for hydraulically moving baling chamber 100 positioned at the anterior rear and the posterior rear of baling chamber 100. In a preferred embodiment, positioned at and attached to the posterior rear of baling chamber 100 is posterior hydraulic cylinder 178 and positioned at and attached to the anterior rear of baling chamber 100 is anterior hydraulic cylinder 179.

Posterior hydraulic cylinder 178 has an exterior and an interior and an upper end and a lower end and houses in its interior posterior hydraulic rod 171 which extends out of and retracts into posterior hydraulic cylinder 178 at the upper end of cylinder 178, with posterior hydraulic rod 171 extending out of posterior hydraulic cylinder 178 during top door 170 opening operation and posterior hydraulic rod 171 retracting into posterior hydraulic cylinder 178 during top door 170 closing operation. Anterior hydraulic cylinder 179 has an exterior and an interior and an upper end and a lower end and houses in its interior anterior hydraulic rod 177 which extends out of and retracts into anterior hydraulic cylinder 179 at the upper end of anterior hydraulic cylinder 179, with anterior hydraulic rod 177 extending out of anterior hydraulic cylinder 179 during top door 170 opening operation and anterior hydraulic rod 177 retracting into anterior hydraulic cylinder 179 during top door 170 closing operation.

Preferably, the attachment of the hydraulic cylinders 178 and 179 to baling chamber 100 comprises hydraulic cylinder support bar 109 having an anterior end and a posterior end, with the exterior lower end of posterior hydraulic cylinder 178 attached to the posterior end of hydraulic cylinder support bar 109 and the exterior lower end of anterior hydraulic cylinder 179 attached to the anterior end of hydraulic cylinder support bar 109, and the hydraulic cylinder support bar 109 attached to baling chamber lower structural member 102. More preferably, hydraulic cylinder support bar 109 attaches to baling chamber lower structural member 102 at a plurality of positions along the longitudinal length of hydraulic cylinder support bar 109. More preferably, the exterior lower end of posterior hydraulic cylinder 178 attaches to a posterior hydraulic cylinder support flange (not pictured or numbered) that is attached to baling chamber lower structural member 102 and the exterior lower end of anterior hydraulic cylinder 179 attaches to anterior hydraulic cylinder support flange (not pictured or numbered) that is attached to baling chamber lower structural member 102, and hydraulic cylinder support bar 109 extends between and is attached to each of posterior hydraulic cylinder support flange (not pictured or numbered) and anterior hydraulic cylinder support flange (not pictured or numbered).

Attached to the upper end of each of anterior hydraulic rod 177 and posterior hydraulic rod 171 is anterior hydraulic rod bracket 113 and posterior hydraulic rod bracket, respectively. Anterior hydraulic rod bracket 113 attaches to anterior door arm rear projection 175 of anterior top door arm 174 and posterior hydraulic rod bracket 115 attaches to posterior door arm rear projection 173 of posterior door arm 172. In a preferred embodiment, each bracket 113 and 115 has anterior plate and a posterior plate spaced apart from anterior plate, with each plate having an aligned and co-axial aperture. The posterior door arm rear projection 173 is positioned in the open space between the posterior and anterior plates of posterior hydraulic rod bracket 115, with the aperture of posterior door arm rear projection 173 positioned coaxially and aligned with the apertures of the anterior and posterior plates of posterior hydraulic rod bracket 115, and a pin is passed through each aperture and secured to one or more plates of posterior hydraulic rod bracket 115. The anterior door arm rear projection 175 is positioned in the open space between the posterior and anterior plates of anterior hydraulic rod bracket 113, with the aperture of anterior door anti rear projection 175 positioned coaxially and aligned with the apertures of the anterior and posterior plates of anterior hydraulic rod bracket 113, and a pin is passed through each aperture and secured to one or more plates of anterior hydraulic rod bracket 113.

Each upper end and each lower end of each hydraulic cylinder 178 and 179 has a hydraulic oil port which allow for hydraulic oil to flow into and out of the interior of hydraulic cylinders 178 and 179 from a source of hydraulic oil of electrical/hydraulic system module 202. Each port is connected via a hydraulic oil line to baling chamber hydraulic oil hub 147, which comprises a plate attached to one or more of baling chamber rear structural member 108 and baling chamber rear wall 110, preferably 108, the plate comprising (i) a plurality of hydraulic cylinder ports attached to hydraulic oil lines connected to hydraulic cylinders 178 and 179 and (ii) a plurality of hydraulic oil source ports, each of which is in fluid communication with one or more of the plurality of hydraulic cylinder ports, with one or more hydraulic oil source ports connected via one or more hydraulic oil lines to a source of hydraulic oil from electrical power/hydraulic system module 202. More preferably, the plurality of hydraulic source ports of baling chamber hydraulic oil hub 147 comprises two ports, with one port connected to first hydraulic oil line 198 and one port connected to second hydraulic oil discharge line 199, each of lines 198 and 199 connected to a source of hydraulic oil from electrical power/hydraulic system module 202. Additionally, and more preferably, the plurality of hydraulic cylinder ports of baling chamber hydraulic oil hub 147 comprises four ports, with one port for each of the upper and lower ends of hydraulic cylinders 178 and 179.

During top door 170 opening operations in the preferable method of hydraulically moving top door 170, hydraulic oil flows from the source of hydraulic oil from electrical power/hydraulic system module 202 through hydraulic oil lines to baling chamber hydraulic oil hub 147 and then to hydraulic cylinders 178 and 179 where hydraulic oil causes rods 171 and 177 to lower and retract into hydraulic cylinders 178 and 179, respectively, which causes posterior and anterior top door arms 173 and 172, respectively, which are connected to rods 171 and 177 by the securing of posterior and anterior door arm rear projections 173 and 175 to posterior and anterior hydraulic rod brackets 115 and 113, respectively, to be lifted vertically and distally to rear of baling chamber 100. During top door 170 closing operations in a preferred embodiment where top door 170 is hydraulically movable, hydraulic oil, flowing from a source of hydraulic oil from electrical power/hydraulic system module 202 to hydraulic cylinders 178 and 179 via lines 198199 which are connected to baling chamber hydraulic oil hub 147 connected via hydraulic oil lines to hydraulic cylinders 178 and 179, causes rods 171 and 177 to raise and extend out of hydraulic cylinders 178 and 179, respectively, which causes posterior and anterior top door arms 173 and 172, respectively, which are connected to rods 171 and 177 by the securing of posterior and anterior door arm rear projections 173 and 175 to posterior and anterior hydraulic rod brackets 115 and 113, respectively, to be lowered vertically and distally to the front of baling chamber 100.

Baling chamber 100 is fitted with a plurality of sets of one or more wheels to allow for mobility of baling chamber 100, each set comprising one or more rear wheels beneath the baling chamber rear structural member 108 and one or more front wheels beneath the baling chamber front structural member 106, the sets of wheels interspersed along the longitudinal axis of baling chamber 100. In a preferred embodiment, baling chamber 100 is fitted with an anterior set of wheels (front 134 and rear 136) proximal the anterior of baling chamber 100, a posterior set of wheels (front 130 and rear 132) proximal the posterior of baling chamber 100, and a center set of wheels (front 138 and rear 139) between anterior and posterior sets of wheels.

In a preferred embodiment, the plurality of sets of wheels are attached to baling chamber 100 via wheel axles. In this embodiment, each wheel axle comprises a lateral bar having a front end and a rear end, a front vertical bar with an upper end and a lower end and that is attached at front vertical bar upper end to lateral bar at lateral bar front end, and a rear vertical bar with an upper end and a lower end and that is attached at rear vertical bar upper end to lateral bar at lateral bar rear end, and one or more front wheels attached to front vertical bar lower end and one or more rear wheels attached to rear vertical bar lower end. Preferably, the lateral bar spans substantially the lateral dimension of baling chamber lower structural member 102. Preferably, front and rear vertical bars are laterally aligned and directly below baling chamber front structural member 106 and baling chamber rear structural member 108, respectively. Alternatively and preferably, front and rear vertical bars are laterally unaligned and to the front or rear of baling chamber front structural member 106 and baling chamber rear structural member 108, respectively, with the upper end of front and rear vertical bar vertically aligned, below, or above baling chamber lower structural member 102.

Preferably, anterior set of wheels comprises one or more anterior front wheels 134 proximal the anterior front of baling chamber 100 and one or more anterior rear wheels 136 proximal the anterior rear of baling chamber 100. Anterior set of wheels is attached to baling chamber 100 via anterior wheel axle comprising an anterior lateral bar, anterior front vertical bar, and anterior rear vertical bar as described above.

Further, in this preferred embodiment, posterior set of wheels comprises one or more posterior front wheels 130 proximal the posterior front of baling chamber 100 and one or more posterior rear wheels 132 proximal the posterior rear of baling chamber 100. Posterior set of wheels is attached to baling chamber 100 via posterior wheel axle comprising a posterior lateral bar, posterior front vertical bar, and posterior rear vertical bar as described above.

Further, in this preferred embodiment, center set of wheels comprises one or more sets of wheels, each longitudinally between anterior and posterior sets of wheels, preferably comprising one or more center front wheels 138 proximal the front of baling chamber 100 and positioned longitudinally between the one or more posterior front wheels 130 and the one or more anterior front wheels 134 and one or more center rear wheels 139 proximal the rear of baling chamber 100 and positioned longitudinally between the one or more posterior rear wheels 132 and the one or more anterior rear wheels 136. Center set of wheels is attached to baling chamber 100 via center wheel axle comprising a center lateral bar longitudinally between anterior lateral bar and posterior lateral bar, center front vertical bar longitudinally between anterior front vertical bar and posterior front vertical bar, and center rear vertical bar longitudinally between anterior rear vertical bar and posterior rear vertical bar as described above.

Alternatively, and in a preferred embodiment, each of the plurality of sets of wheels is attached to baling chamber 100 via vertical support bars, each vertical support bar having an upper end and a lower end. In this embodiment, each of the sets of wheels, each set comprising one or more wheels, is attached to the lower end of a vertical support bar, with the upper end of each such vertical support bar attached to baling chamber lower structural member 102. Preferably, in this embodiment, baling chamber 100 is fitted with an anterior set of wheels proximal the anterior of baling chamber 100, a posterior set of wheels proximal the posterior of baling chamber 100, and a center set of wheels between the anterior set of wheels and posterior set of wheels, with any wheels proximal the front of baling chamber 100 attached to baling chamber lower structural member 102 via front vertical support bars and any wheels proximal the rear of baling chamber 100 attached to baling chamber lower structural member 102 via rear vertical support bars. The front and rear vertical support bars are, in a preferred embodiment, laterally aligned and directly below baling chamber front structural member 106 and baling chamber rear structural member 108, respectively. In an alternative preferred embodiment, the front and rear vertical support bars are laterally unaligned with baling chamber front structural member 106 and baling chamber rear structural member 108 and positioned to the front or rear of baling chamber front structural member 106 and baling chamber rear structural member 108, respectively. In an alternative preferred embodiment, front and rear vertical support bars are laterally aligned with the front longitudinal end and rear longitudinal end of baling chamber lower structural member 102, respectively. Moreover, in a preferred embodiment where the front and rear vertical support bars are laterally unaligned with baling chamber front structural member 106 and baling chamber rear structural member 108, respectively, the upper ends of the vertical support bars extend vertically above baling chamber lower structural member 102. Moreover, and alternatively, the vertical support bar upper ends can be comprised of perimeter (hollow) segments.

Preferably, in an embodiment where baling chamber wheels are attached via vertical support bars, anterior set of wheels comprises (i) one or more anterior front wheels 134 proximal the anterior front of baling chamber 100 and attached to the lower end of anterior front vertical support bar and the upper end of anterior front vertical support bar is attached to baling chamber lower structural member 102 proximal to baling chamber lower structural member 102 front longitudinal end, and (ii) one or more anterior rear wheels 136 proximal the anterior rear of baling chamber 100 and attached to the lower end of anterior rear vertical support bar and the upper end of anterior rear vertical support bar is attached to baling chamber lower structural member 102 proximal to baling chamber lower structural member 102 rear longitudinal end. Preferably, the anterior front vertical support bar is attached to the front longitudinal end of baling chamber lower structural member 102 and the anterior rear vertical support bar is attached to the rear longitudinal end of baling chamber lower structural member 102.

Moreover, in this embodiment, posterior set of wheels comprises (i) one or more posterior front wheels 130 proximal the posterior front of baling chamber 100 and attached to the lower end of posterior front vertical support bar and the upper end of posterior front vertical support bar is attached to baling chamber lower structural member 102 proximal to baling chamber lower structural member 102 rear longitudinal end, and (ii) one or more posterior rear wheels 134 proximal the posterior rear of baling chamber 100 and attached to the lower end of p[posterior rear vertical support bar and the upper end of posterior rear vertical support bar is attached to baling chamber lower structural member 102 proximal to baling chamber lower structural member 102 rear longitudinal end. Preferably, the posterior front vertical support bar is attached to the front longitudinal end of baling chamber lower structural member 102 and the posterior rear vertical support bar is attached to the rear longitudinal end of baling chamber lower structural member 102.

Moreover, in this embodiment, center set of wheels comprises (i) one or more center front wheels 138 proximal the front of baling chamber 100 and positioned longitudinally between the one or more posterior front wheels 130 and the one or more anterior front wheels 134, the one or more center front wheels 138 attached to the lower end of center front vertical support bar and the upper end of center front vertical support bar is attached to baling chamber lower structural member 102 proximal the front longitudinal end of baling chamber lower structural member 102 and (ii) one or more center rear wheels 139 proximal the rear of baling chamber 100 and positioned longitudinally between the one or more posterior rear wheels 132 and the one or more anterior rear wheels 136, the one or more center rear wheels 139 attached to the lower end of center rear vertical support bar and the upper end of center rear vertical support bar is attached to baling chamber lower structural member 102 proximal the rear longitudinal end of baling chamber lower structural member 102. Preferably, the posterior front vertical support bar is attached to the front longitudinal end of baling chamber lower structural member 102 and the posterior rear vertical support bar is attached to the rear longitudinal end of baling chamber lower structural member 102.

In another preferred alternative embodiment, the plurality of sets of wheels are comprised of one or more sets of wheels attached to baling chamber 100 via wheel axles as described above and one or more sets of wheels attached to baling chamber 100 via vertical support bars attached to baling chamber lower structural member 102 as described above.

Preferably one or more of the baling chamber rear structural member 108 and baling chamber rear wall 110 has one or more strapping rear buckles 107 positioned on the rear of baling chamber 100, and preferably one or more of the baling chamber front structural member 106 and baling chamber front wall 104 has one or more strapping front buckles 105 positioned on the front of baling chamber 100 onto which can be tied various straps and can function as handles onto which an operator can place his or her hands to control the movement of cylindrical frame 200. More preferably, one or more of the rear of baling chamber 100 and front of baling chamber 100 has a plurality of front buckles 107 and rear buckles 105, respectively.

Cylinder frame: Cylinder frame 200 comprises front structural member 210, posterior structural member 212, and rear structural member 214, with the front structural member 210 and rear structural member 214 defining a longitudinal axis of cylinder frame 200 and posterior structural member 212 defining a lateral axis of cylinder frame 200. Structural members 210, 212, and 214 can be comprised of either (i) one integral structure, wherein structural members 210, 212, and 214 are formed from one structure, or (ii) a plurality of structural members attached together at the front posterior and rear posterior corners of cylinder frame 200 located on posterior structural member 212, with front structural member 210 attached to posterior structural member 212 at the front posterior corner of cylinder frame 200 and rear structural member 214 attached to posterior structural member 212 at the rear posterior corner of cylinder frame 200.

Figure 13:
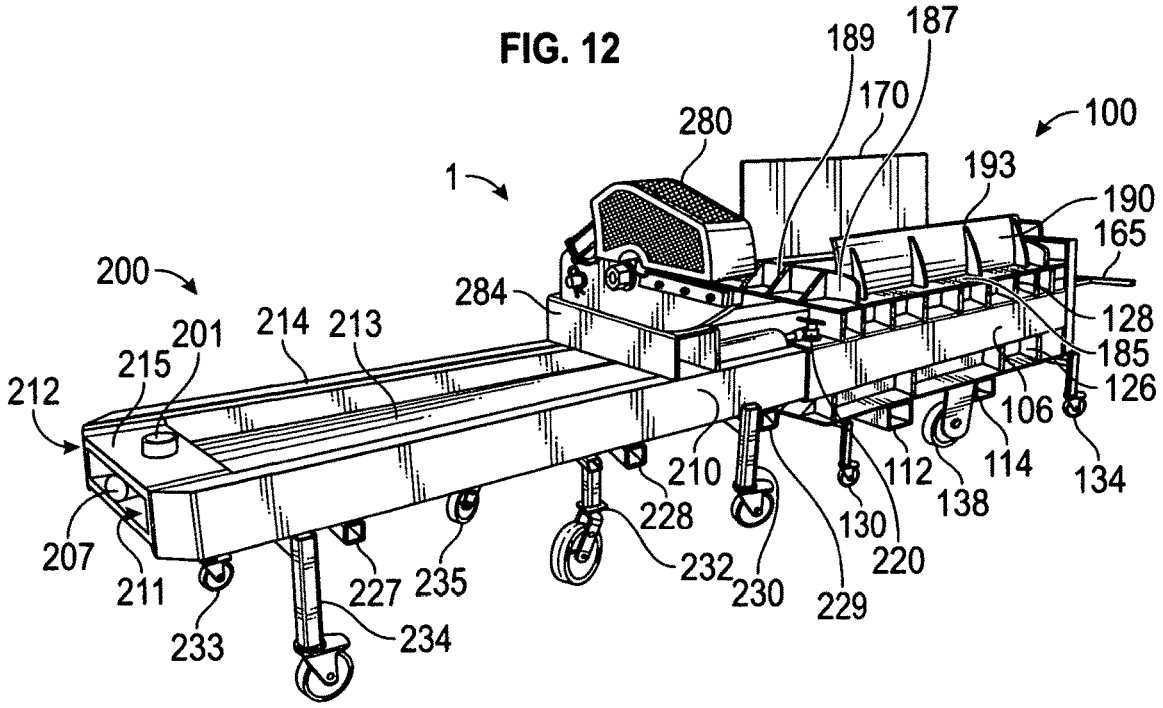
FIG. 13 is a perspective view of an embodiment of the present invention.
Figure 15:
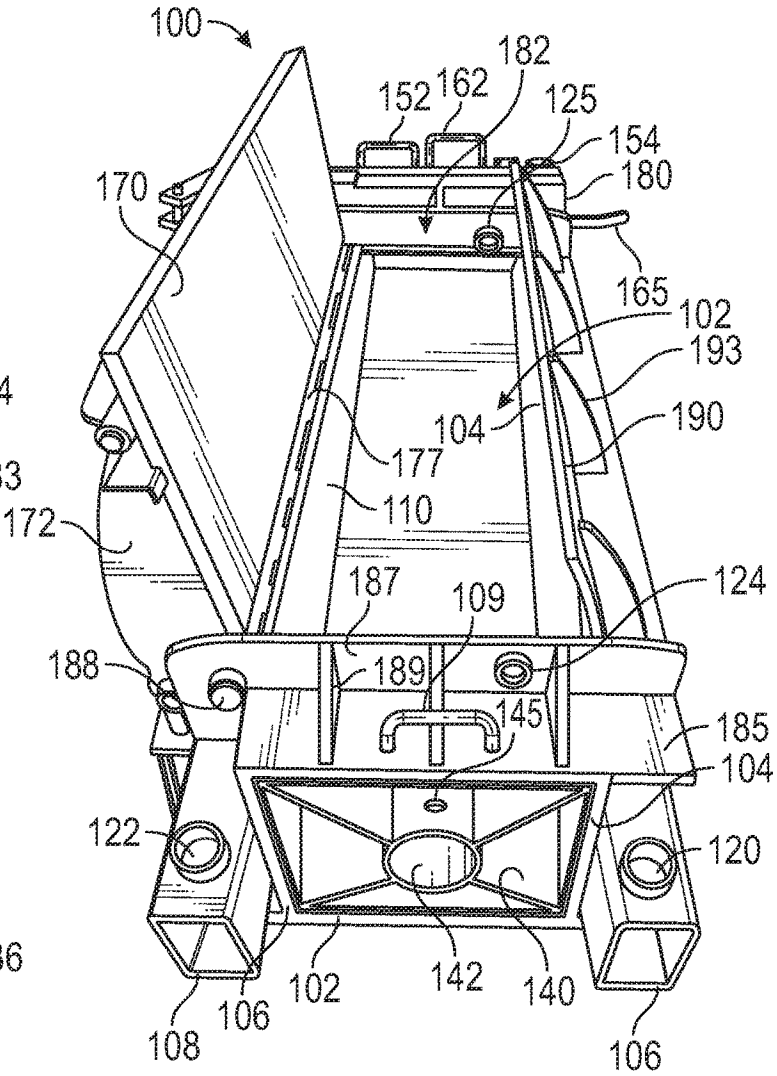
FIG. 15 is a perspective view of the baling chamber from the perspective at the posterior of the baling chamber in the background toward the anterior of the baling chamber in the foreground of an embodiment of the present invention.
Figure 14:
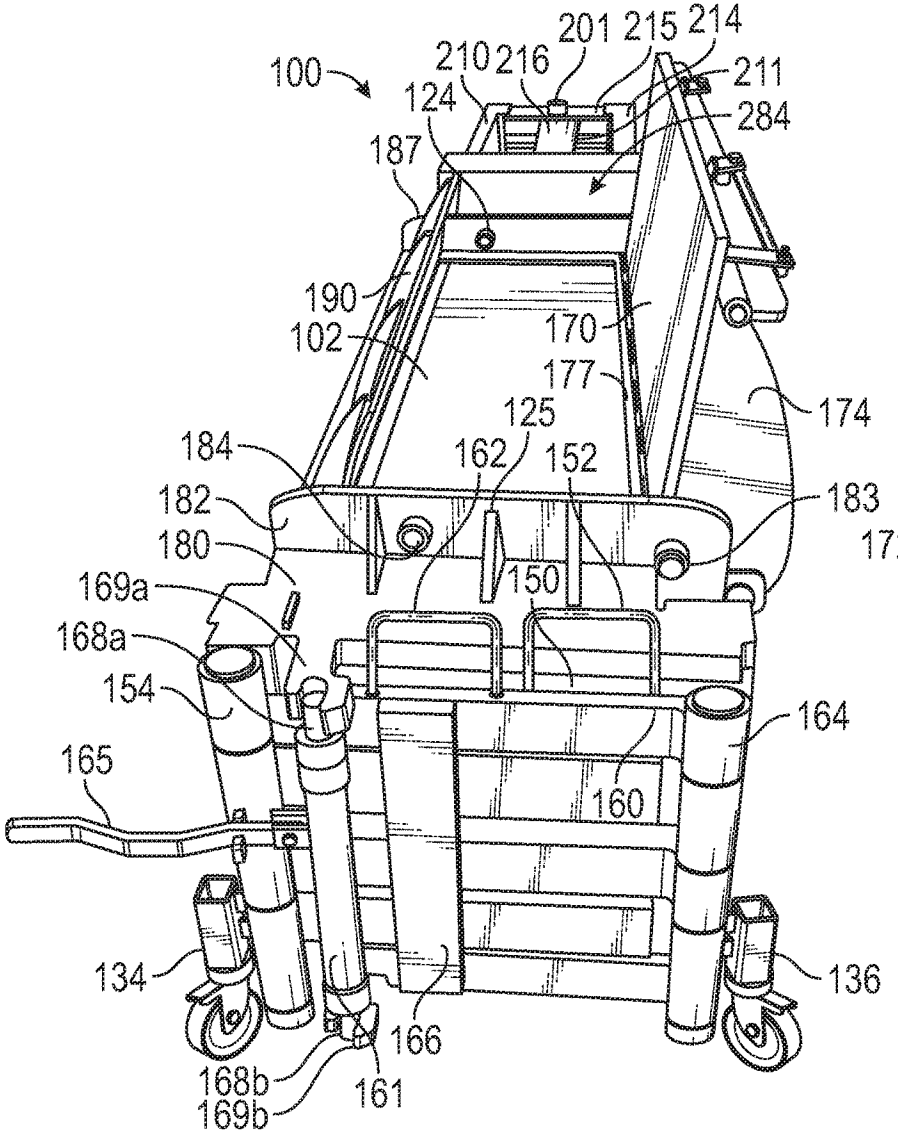
FIG. 14 is a perspective view of the baling chamber from the perspective at the anterior of the baling chamber in the foreground toward the posterior of the baling chamber in the background of an embodiment of the present invention.
Figure 16:
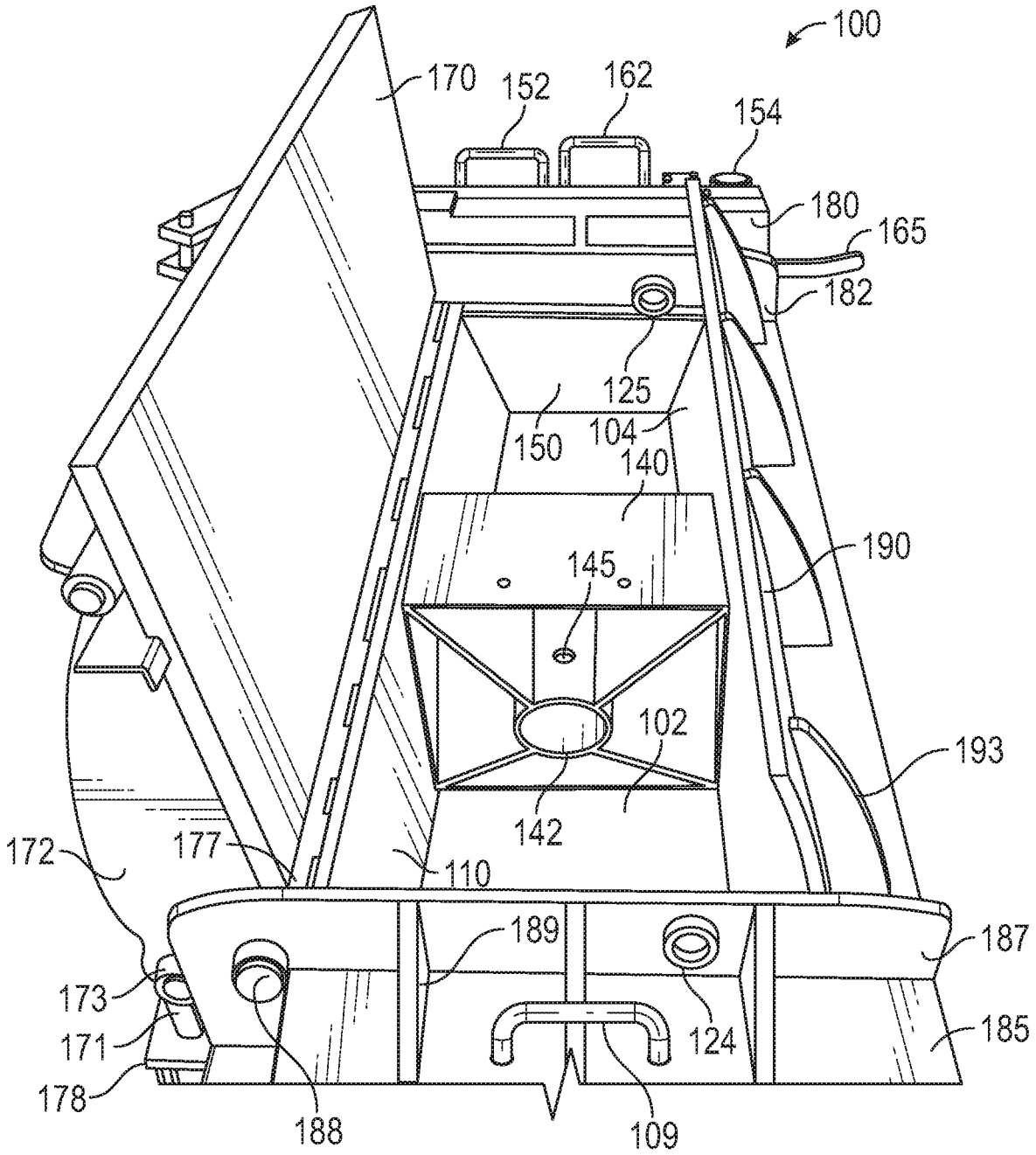
FIG. 16 is a partial perspective view of the baling chamber with the pusher block in the middle of the baling chamber of an embodiment of the present invention.
Figure 17:
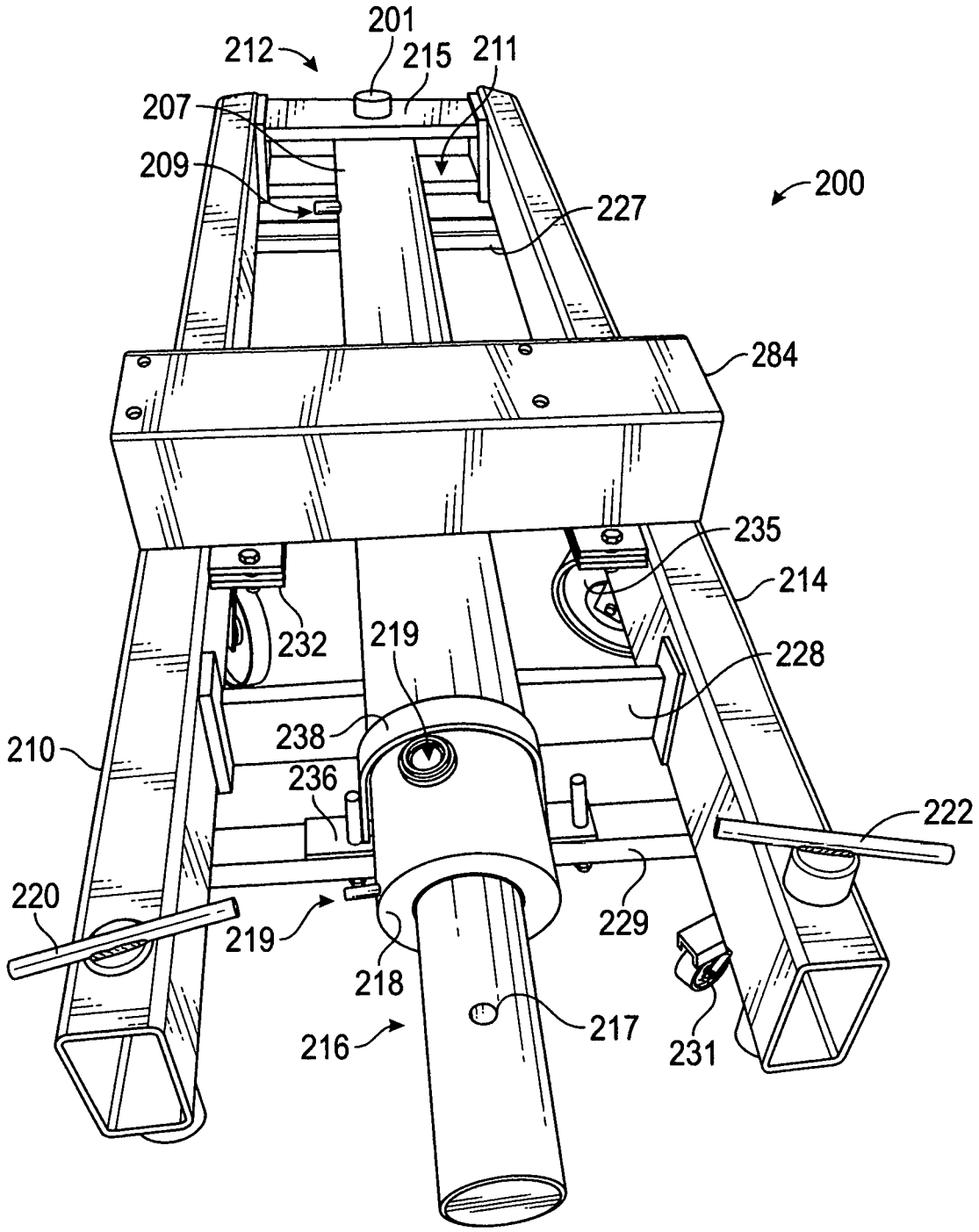
FIG. 17 is a perspective view of the cylinder frame of an embodiment of the present invention.

Preferably, and as shown in FIGS. 13 and 17, posterior structural member 212 is comprised of upper posterior structural member 215 and lower posterior structural member 211, with the (i) rear ends of the upper posterior structural member 215 and lower posterior structural member 211 of posterior structural member 212 attached to rear structural member 214 at the rear posterior corner of cylinder frame 200, and (ii) front ends of the upper posterior structural member 215 and lower posterior structural member 211 of posterior structural member 212 attached to front structural member 210 at the front posterior corner of cylinder frame 200. Alternatively, and in a preferred embodiment, posterior structural member 212 is comprised of an integral structural member.

Figure 6:
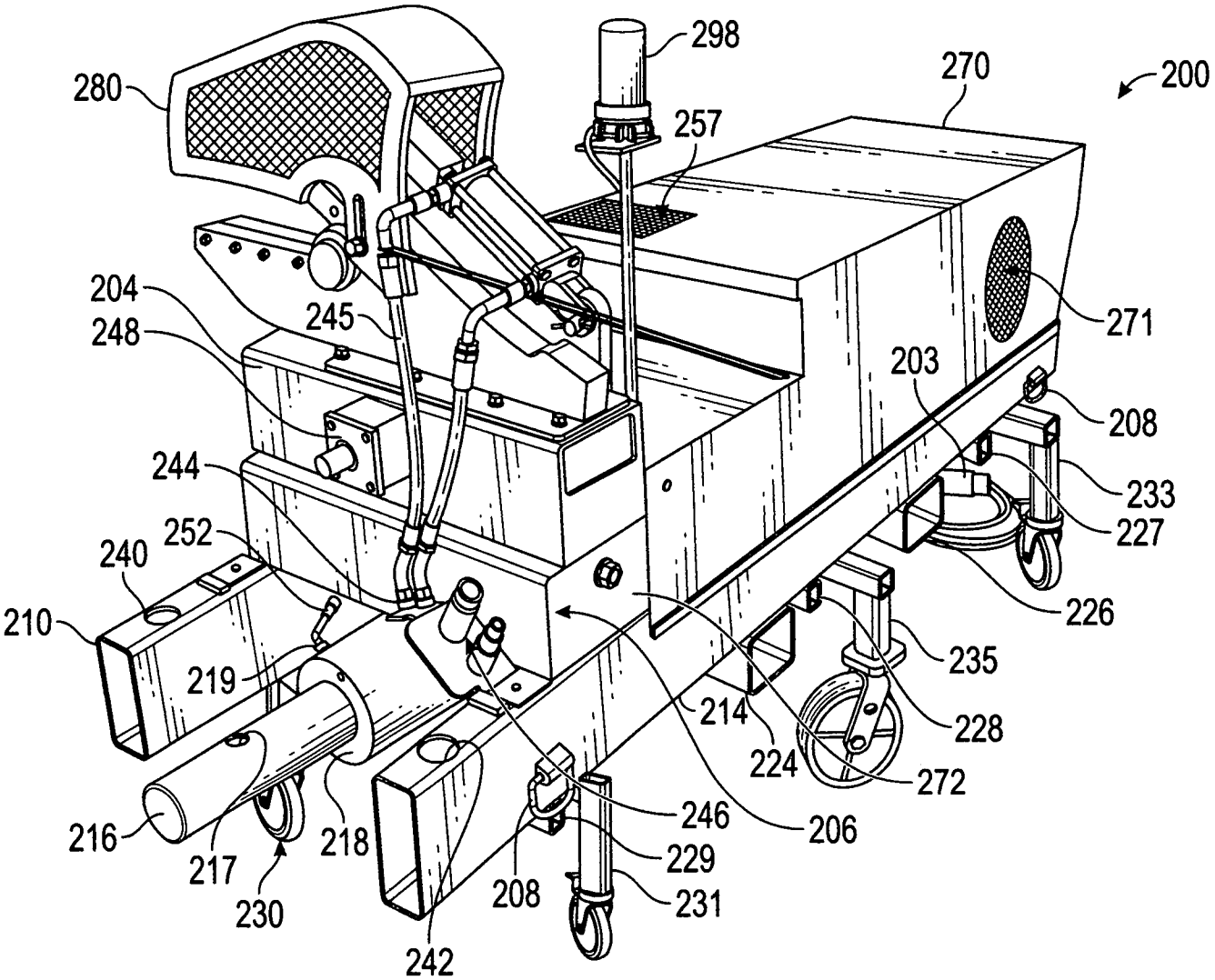
FIG. 6 is a perspective view of the cylinder frame with the shear module at the anterior end of the cylinder frame of an embodiment of the present invention.
Figure 7:
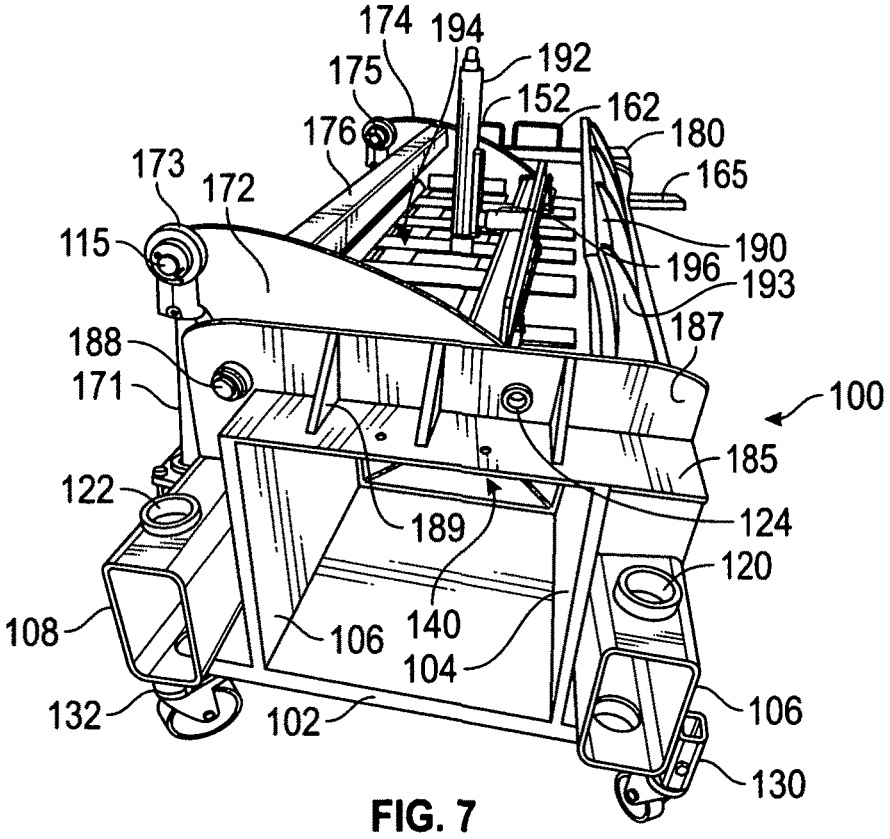
FIG. 7 is a perspective view of the baling chamber from a perspective at the anterior of the baling chamber in the foreground toward the posterior of the baling chamber in the background of an embodiment of the present invention.
Figure 8:
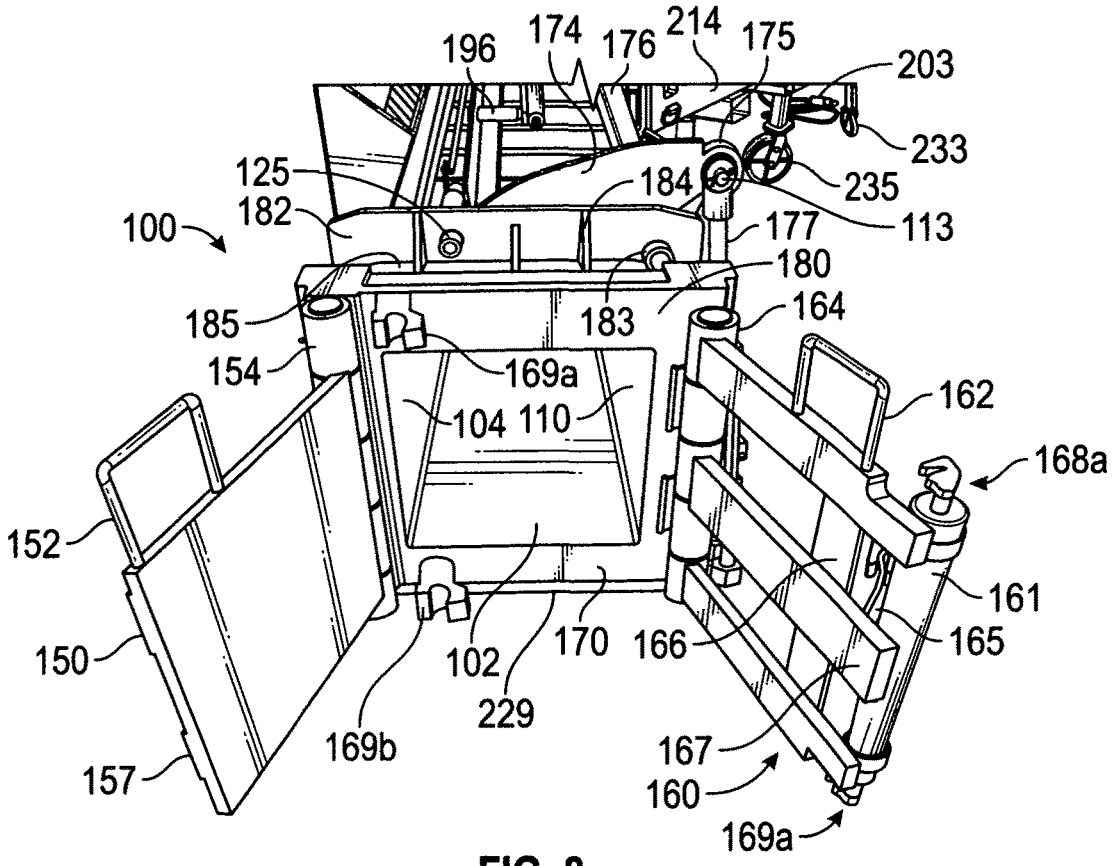
FIG. 8 is a partial perspective rear view of the baling chamber from a perspective at the anterior of the baling chamber in the foreground toward the posterior of the baling chamber in the background of an embodiment of the present invention.

With reference to FIG. 6, the anterior ends of front structural member 210 and rear structural member 214 are substantially similar and comprise perimeter segments (upper, lower, front, rear) surrounding an open interior, with the upper perimeter segment of each structural member having an aperture, with the upper perimeter segment of front structural member 210 having aperture 240 and the upper perimeter segment of rear structural member 214 having aperture 242. Preferably, the interiors of front structural member 210 and rear structural member 214 posterior the anterior ends of members 210 and 214 are solid.

In a preferred embodiment, positioned below and attached to the underside of front structural member 210 is one or more cylinder frame fork pocket, preferably a plurality of fork pockets comprising anterior cylinder frame fork pocket 224 and posterior cylinder frame fork pocket 226.

Positioned laterally between front structural member 210 and rear structural member 214 is hydraulic cylinder 213. Preferably, hydraulic cylinder 213 is positioned laterally equidistant to front structural member 210 and rear structural member 214. Hydraulic cylinder 213 can be any one of multiple known hydraulic cylinders used in the art.

In a preferred embodiment, hydraulic cylinder 213 is a double-acting cylinder comprising cylinder casing 218 and cylinder rod 216. Affixed to cylinder casing 218 is one or more hydraulic oil ports attached via one or more hydraulic oil lines to a source of hydraulic oil from the electrical power/hydraulic system module 202. In a preferred embodiment, at least one or more posterior cylinder hydraulic oil ports 209 is attached to the posterior of cylinder casing 218. Affixed to the anterior of cylinder casing 218 is one or more anterior cylinder hydraulic oil ports 219 attached via one or more hydraulic oil lines to a source of hydraulic oil from the electrical power/hydraulic system module 202. More preferably, affixed to the anterior of cylinder casing 218 is a first anterior cylinder hydraulic oil port 219 and a second anterior cylinder hydraulic oil port 221.

Cylinder casing 218 is hollow comprising a thin shell structure at the portions of cylinder casing 218 at which ports 209 and 219 are positioned such that hydraulic oil flowing through such ports 209 and 219 into the interior of cylinder casing 218 are in fluid communication with the outer surface of cylinder rod 216. Preferably, cylinder casing 218 is hollow substantially the entire longitudinal length of cylinder casing 218.

Cylinder rod 216 is a solid (integral) structure and is sheathed within cylinder casing 218 except at the anterior portion of cylinder rod 216 that is unsheathed by cylinder casing 218. Cylinder rod 216 is extendable out of cylinder casing 218, being displaced longitudinally to the anterior of cylinder frame 200 and causing more of cylinder rod 216 to be unsheathed by cylinder casing 218, when pressurized hydraulic oil flowing from a source of hydraulic oil of electrical power/hydraulic system module 202 through at least one hydraulic oil port on cylinder casing 218 and into the interior of cylinder casing 218 applying force on a surface of cylinder rod 216, preferably such one or more hydraulic oil ports comprising one or more posterior cylinder hydraulic oil ports 209 and such surface comprises a surface of cylinder rod 216 positioned at the posterior of hydraulic cylinder 213.

This extension of cylinder rod 216 out of cylinder casing 218 is performed during operation of modular baler 1 to compress uncompressed metal in baling chamber 100. Cylinder rod 216 retracts into cylinder casing 218, being displaced longitudinally to the posterior of cylinder frame 200 and causing more of cylinder rod 216 to be sheathed by cylinder casing 218, when hydraulic oil under pressure lower than the hydraulic oil pressure during metal compression operation of modular baler 1 when uncompressed metal is placed in baling chamber 100, flows from a source of hydraulic oil of electrical power/hydraulic system module 202 through at least one hydraulic cylinder oil port 211 of cylinder casing 218 and into the interior of cylinder casing 218 applying force on a surface of cylinder rod 216, preferably such surface of cylinder rod 216 and port 211 positioned at the anterior of hydraulic cylinder 213. This retraction of cylinder rod 216 into cylinder casing 218 is performed during operation of modular baler 1 after compression of metal in baling chamber 100 in preparation for metal compression operation during the next baling cycle.

The upper surface of the anterior portion of cylinder rod 216 has aperture 217, preferably substantially circular in cross section. Preferably, aperture 217 is positioned longitudinally anterior of apertures 240 and 242 of the upper perimeter segments of front structural member 210 and rear structural member 214, respectively. The anterior portion of cylinder rod 216 extends longitudinally beyond the anterior ends of front structural member 210 and rear structural member 214.

Cylinder casing 218 extends longitudinally most of the longitudinal length of cylinder frame 200, preferably longitudinally from longitudinal position posterior apertures 240 and 242 of the upper perimeter segments of front structural member 210 and rear structural member 214, respectively, to posterior structural member 212. Preferably, the posterior portion of cylinder shell 218 does not extend longitudinally beyond posterior structural member 212.

Hydraulic cylinder 213 is secured to posterior structural member 212 to prevent vertical, lateral, or longitudinal displacement of cylinder casing 218. In a preferred embodiment, tang 207 is attached to the posterior of cylinder casing 218. In embodiments where tang 207 is attached to cylinder casing 218 and one or more posterior cylinder hydraulic oil ports 209 is positioned at the posterior of cylinder casing 218, the one or more posterior cylinder hydraulic oil ports 209 of cylinder casing 218 is or are positioned anterior of the tang 207-cylinder casing 218 attachment. Tang 207 has an aperture extending vertically through the tang 207 from the upper to the lower surfaces of the tang 207. Preferably, posterior structural member 212 is comprised of upper and lower posterior structural members 215 and 211, respectively, each with an aperture substantially in the lateral midpoint of the members 211 and 215. Hydraulic cylinder 213 is secured to posterior structural member 212 via pin 201 extending vertically and through the aperture on upper posterior structural member 215 of posterior structural member 212, through the tang 207 aperture, and through the aperture on lower posterior structural member 211 of posterior structural member 212. Preferably, the upper end of pin 201 is flush, at the same vertical position, as upper posterior structural member 215. More preferably, a plate is attached over the lower end of pin 201, with the plate welded to the underside of the lower posterior structural member 211 of posterior structural member 212.

Along the longitudinal axis of cylinder frame 200 is one or more lateral support bars spanning and attached to the front structural member 210 an d rear structural member 214, with such one or more lateral support bars supporting hydraulic cylinder 213. Each lateral support bar has a front end beneath and attached to front structural member 210 and a rear end beneath and attached to rear structural member 214. Preferably, cylinder frame 200 has anterior support bar 229 positioned anterior of anterior wheels 230 and 231. More preferably, cylinder frame 200 has, in addition to anterior support bar 229, middle support bar 228 which can be either anterior or posterior of a center set of wheels 232. Still more preferably, cylinder frame 200 has, in addition to anterior support bar 229, posterior support bar 227.

Cylinder support ring 238 secures cylinder 213 to cylinder frame 200 at least of the one or more lateral support bars. In a preferred embodiment, cylinder support ring 238 comprises a front vertical portion, rear vertical portion, and a substantially half-circular middle portion between front and rear vertical portions. Cylinder support ring 238 is preferably attached to anterior support bar 229, preferably the vertical portions of cylinder support ring 238 are attached to anterior support bar 229. More preferably, cylinder support ring 238 further comprises a horizontal portion 236 and wherein front vertical portion and rear vertical portion of cylinder support ring 238 are attached to horizontal portion 236 and horizontal portion 236 is attached to anterior support bar 230. More preferably, additional cylinder support rings can be placed over cylinder 213 at additional longitudinal positions of cylinder 213, with such cylinder support rings attached to either a wheel axle or a lateral support bar.

In a preferred embodiment, front vertical portion of cylinder support ring 238 is attached to anterior support bar 229 at a lateral position on anterior support bar 229 between front structural member 210 and hydraulic cylinder 213. Rear vertical portion of cylinder support ring 238 is attached to anterior support bar 229 at a lateral position on anterior support bar 229 between hydraulic cylinder 213 and rear structural member 214. The substantially half-circular middle portion of cylinder support ring 238 extends (i) over hydraulic cylinder 213 and, (ii) from, front to rear, front vertical portion of cylinder support ring 238 to rear vertical portion of cylinder support ring 238. Preferably, the substantially half-circular middle portion of cylinder support ring 238 has a diameter, defined by the vertical distance from the upper surface of anterior support bar 229 to the uppermost portion of cylinder support ring 238, slightly greater than diameter of cylinder shell 218 of hydraulic cylinder 213 in order to extend over hydraulic cylinder 213 and laterally and vertically secure hydraulic cylinder 213 in the substantially half-circular interior space between support ring 238 and anterior support bar 229 while allowing for the longitudinal displacement of cylinder rod 216 via extension of cylinder rod 216 out of cylinder casing 218 of hydraulic cylinder 213. Preferably, cylinder support ring 238 is positioned longitudinally on cylinder casing 218 posterior of the longitudinal position where cylinder rod 216 emerges unsheathed from cylinder casing 218. More preferably in an embodiment where support ring 238 further comprises a horizontal portion 236, such horizontal portion has one or more apertures, preferably with an aperture on horizontal portion to the front of front vertical portion and an aperture on horizontal portion to the rear of cylinder casing 218 but to the front of rear vertical portion. Such one or more apertures on horizontal portion of cylinder support ring 238 is or are positioned over one or more apertures on the lateral support bar to which cylinder support ring 238 is attached, preferably anterior lateral support bar 229, with bolts, pins, screws, or other attaching structures inserted through each horizontal portion aperture and lateral support bar aperture to laterally secure cylinder support ring 238 to the lateral support bar.

Cylinder frame 200 is fitted with a plurality of sets of one or more wheels to allow for mobility of cylinder frame 200, each set comprising one or more rear wheels beneath the rear structural member 214 and one or more front wheels beneath the front structural member 210, the sets of wheels interspersed along the longitudinal axis of cylinder frame 200. In a preferred embodiment, cylinder frame 200 is fitted with an anterior set of wheels 230 (rear 231 and front 230) proximal the anterior of cylinder frame 200, a posterior set of wheels (rear 233 and front 234) proximal the posterior of cylinder frame 200, and a center set of wheels (rear 235 and front 232) between anterior and posterior sets of wheels.

In a preferred embodiment, the plurality of sets of wheels are attached to cylinder frame 200 via wheel axles. In this embodiment, each wheel axle comprises a front vertical bar beneath and attached to front structural member 210, a rear vertical bar beneath and attached to rear structural member 214, and a lateral cross member spanning the lateral distance between front structural member 210 and rear structural member 214, with the upper end of the front vertical bar attached to the front end of lateral cross member and the upper end of the rear vertical bar attached to the rear end of lateral cross member, and one or more wheels attached to the lower end of each of the front and rear vertical bars. The lateral cross member of each wheel axle of cylinder frame 200 may or may not provide lateral support to hydraulic cylinder 213. Preferably, a wheel axle of cylinder frame 200 provides lateral support of hydraulic cylinder 213.

Preferably, anterior set of wheels comprises one or more anterior front wheels 230 beneath front structural member 210 proximal the anterior end of cylinder frame 200 and one or more anterior rear wheels 231 beneath rear structural member 214 proximal the anterior end of cylinder frame 200. Anterior set of wheels is attached to cylinder frame 200 via anterior wheel axle comprising (i) an anterior front vertical bar beneath and attached to front structural member 210, (ii) an anterior rear vertical bar beneath and attached to rear structural member 214, and (iii) an anterior lateral cross member spanning the lateral distance between front structural member 210 and rear structural member 214, with the upper end of the anterior front vertical bar attached to the front end of anterior lateral cross member and the upper end of the anterior rear vertical bar attached to the rear end of the anterior lateral cross member. Attached to the lower end of each of the anterior front and rear vertical bars is one or more anterior front wheels 230 and one or more anterior rear wheels 231, respectively.

Further, in this preferred embodiment, posterior set of wheels comprises one or more posterior front wheels 234 beneath front structural member 210 proximal the posterior end of cylinder frame 200 and one or more posterior rear wheels 233 beneath rear structural member 214 proximal the posterior end of cylinder frame 200. Posterior set of wheels is attached to cylinder frame 200 via posterior wheel axle comprising (i) a posterior front vertical bar beneath and attached to front structural member 210, (ii) a posterior rear vertical bar beneath and attached to rear structural member 214, and (iii) a posterior lateral cross member spanning the lateral distance between front structural member 210 and rear structural member 214, with the upper end of the posterior front vertical bar attached to the front end of posterior lateral cross member and the upper end of the posterior rear vertical bar attached to the rear end of the posterior lateral cross member. Attached to the lower end of each of the posterior front and rear vertical bars is one or more posterior front wheels 234 and one or more posterior rear wheels 233, respectively.

Further, in this preferred embodiment, center set of wheels comprises one or more front wheels 232 beneath front structural member 210 between the one or more anterior front wheels 230 and the one or more posterior front wheels 234 and one or more rear wheels 235 beneath rear structural member 214 and between the one or more anterior rear wheels 233 and the one or more posterior rear wheels 231. Center set of wheels is attached to cylinder frame 200 via center wheel axle comprising (i) a center front vertical bar beneath and attached to front structural member 210 and between the anterior front vertical bar of anterior wheel axle and the posterior front vertical bar of posterior wheel axle, (ii) a center rear vertical bar beneath and attached to rear structural member 214 and between the anterior rear vertical bar of anterior wheel axle and the posterior rear vertical bar of posterior wheel axle, and (iii) a center lateral cross member spanning the lateral distance between front structural member 210 and rear structural member 214 and between the anterior lateral cross member of anterior wheel axle and the posterior lateral cross member of posterior wheel axle, with the upper end of the center front vertical bar attached to the front end of center lateral cross member and the upper end of the center rear vertical bar attached to the rear end of the center lateral cross member. Attached to the lower end of each of the center front and rear vertical bars is one or more center front wheels 232 and one or more center rear wheels 235, respectively.

Alternatively to wheel axles, and in a preferred embodiment, the plurality of sets of wheels are attached to cylinder frame 200 via a plurality of lateral support bars, with the lateral support bars serving as wheel axles. In another preferred alternative embodiment, the plurality of sets of wheels are comprised of one or more sets of wheels attached to cylinder frame 200 via wheel axles as described above and one or more sets of wheels attached to cylinder frame 200 via lateral support bars as described above. In another preferred alternative embodiment, the plurality of sets of wheels are comprised of one or more sets of wheels attached to cylinder frame 200 via vertical bars directly attached to one of structural members 210, 212, and 214 wherein each vertical bar has an upper end and a lower end and wherein the vertical bar is attached to a structural member at its upper end and the one or more wheels are attached to the vertical bar lower end.

Preferably one or more of the front structural member 210 and rear structural member 214 has one or more strapping buckles 208 onto which can be tied various straps and can function as handles onto which an operator can place his or her hands to control the movement of cylindrical frame 200. More preferably, each of members 210 and 214 has two buckles 208, one positioned at the anterior of cylinder frame 200 and one positioned at the posterior of cylinder frame 200.

Electrical Power/Hydraulic System Module: Positioned at the posterior and center of cylinder frame 200 is electrical system/hydraulic system module 202 comprising a source of hydraulic oil, a source of electricity (electrical power), and means of distributing electricity and hydraulic oil to components of cylinder frame 200 and baling chamber 100 via hydraulic oil lines and electrical power lines. In a preferred embodiment, the electrical system/hydraulic system module 202 comprises (i) control panel 204 which includes a control mechanism for electrical motor 250*a*, (ii) power cord 203 connected to control panel 204 that can connect electrically to an electrical outlet or other electricity source, (iii) a source of hydraulic oil 272, preferably such source comprising hydraulic oil tank 272, with hydraulic oil tank 272 attached to one or more of front structural member 210 and rear structural member 214 of cylinder frame 200, with hydraulic oil tank 272 preferably attached to both members 210 and 214 and extending laterally between such members 210 and 214, (iv) electrical motor/hydraulic pump module comprising electrical motor 250*a* physically connected to hydraulic oil pump 250*b* in fluid communication with a source of hydraulic oil via hydraulic pump feed line 255, with at least electric motor 250*a* mounted to support 251, with support 251 attached to one or more of rear structural member 214, posterior structural member 212, and front structural member 210, with support 251 preferably mounted to both member 210 and 214 and extending laterally between members 210 and 214, (v) control valve 205 in fluid communication with hydraulic oil pump 250*b* via control valve hydraulic oil feed line 256, with control valve 205 including one or more control levers 253 and one or more hydraulic oil lines 254 in fluid communication with hydraulic cylinder 213 and hydraulic cylinders 178 and 179 of baling chamber 100, (vi) hydraulic oil filter 252 in fluid communication with a source of hydraulic oil, and (vii) shear valve 206 in fluid communication with control valve 205 via one or more hydraulic oil lines 254 and electrically connected to electrical motor 250*a*.

Preferably, the amperage draw (power consumed by) of the electrical power/hydraulic system module 202 is in the range of approximately 10 amps to approximately 15 amps at 480 volts and provides sufficient power to generate a hydraulic cylinder 213 pressure (the pressure inside the cylinder casing 218 of hydraulic cylinder 213 acting on a surface of cylinder rod 216 of cylinder 213) to longitudinally displace cylinder rod 216 in the anterior direction.

Control panel 204 is attached to one or more of front structural member 210, rear structural member 214, and posterior structural member 212. Control panel 204 preferably is attached to front structural member 210 and rear structural member 214 of cylinder frame 200. Additionally, and preferably, in an embodiment where posterior structural member 212 comprises an upper posterior structural member 215 and a lower posterior structural member 211, (i) control panel 204 is attached to upper posterior structural member 215, and (ii) support 251 is attached to upper posterior structural member 215.

Preferably, support 251 comprises one or more horizontal members attached to one or more of members 210, 212, and 214 and that supports at least electrical motor 250*a*, more preferably and additionally hydraulic oil pump 250*b*. More preferably, support 251 also comprises one or more posterior vertical members that attach to the anterior of control panel 204. Additionally, control panel 204 can be attached to one or more of posterior structural member 212 and support 251, with any attachment of control panel 204 to posterior structural member 212 occurring on the underside of control panel 204 and any attachment of control panel 204 to support 251 occurring at one or more of the anterior of control panel 204 or the underside of control panel 204.

The components of electrical power/hydraulic system module 202 comprise conventional electrical and hydraulic oil system components known in the art. The electric motor 250*a* can be any one of multiple known electric motors or hydraulic pumps used in the art. Preferably, electric motor 250*a* is a three phase (3ph) motor that provides approximately ten hp (10 horsepower) that electrically drives hydraulic oil pump 250*b* to which it is physically connected, electrically operates shear valve 206, and provides power at least one or more other components of modular baler 1 as described herein. Hydraulic oil pump 250*b* can be any one of multiple known hydraulic oil pumps used in the art. Preferably, hydraulic oil pump 250*b* is a rotary vane pump. Control valve 205 can be any one of multiple known valves used in the art. Preferably, control valve 205 is a manually operated hydraulic control valve. Shear valve 206 can be any one of multiple known valves used in the art. Preferably, shear valve 206 is a solenoid valve.

Hydraulic oil tank 272 can be any one of multiple known hydraulic oil tanks used in the art. Preferably, hydraulic oil tank 272 provides a hydraulic oil capacity of approximately thirty (30) U.S. gallons. Any known hydraulic oil used in the art can be filled into hydraulic oil tank 272. Preferably, a hydraulic oil that includes anti-wear (AW) additives is used. Preferably, hydraulic oil pump 250*b* provides a pressurized hydraulic oil flow in the range of approximately five (5) U.S. gallons per minute to approximately fifteen (15) U.S. gallons per minute. Hydraulic oil tank 272 extends longitudinally along cylinder frame 200, preferably to the anterior of cylinder frame 200 to a position posterior of apertures 240 and 242 on front structural member 210 and rear structural member 214, respectively. Preferably, hydraulic oil tank 272 is removably attached to cylinder frame 200.

As indicated earlier herein, hydraulic oil tank 272 has hydraulic connections, via hydraulic oil lines, to multiple components of modular baler 1. Preferably, hydraulic oil tank 272 provides a low pressure hydraulic oil flow, first from hydraulic oil tank 272 to hydraulic oil filter 252 via hydraulic pump feed line 255 connecting hydraulic oil tank 272 to hydraulic oil filter 252, and then from hydraulic oil filter 252 to the intake (low pressure side) of hydraulic oil pump 250*b*. Hydraulic oil pump 250*b* pressurizes hydraulic oil entering hydraulic oil pump 250*b* and discharges pressurized hydraulic oil through the outtake of hydraulic oil pump 250*b* to control valve 205 via control valve hydraulic oil feed line 256 between the outtake of hydraulic oil pump 250*b* and control valve 205.

Control valve 205 has a plurality of outlet ports in fluid communication with, via one or more hydraulic oil lines 254, (i) hydraulic cylinder 213, with one or more hydraulic oil lines 254 connecting one or more control valve 205 outlet ports to one or more posterior cylinder hydraulic oil ports 209 on cylinder casing 218 and one or more control valve 205 outlet ports to one or more anterior cylinder hydraulic oil ports 219 on cylinder casing 218, (ii) hydraulic cylinders 178 and 179 on baling chamber 100, with one or more hydraulic oil lines 254 connecting one or more control valve 205 outlet ports to cylinders 178 and 179 for top door 170 opening operations and one or more hydraulic oil lines 254 connecting one or more control valve 205 outlet ports to cylinders 178 and 179 for top door 170 closing operations, and (iii) shear valve 206, with one or more hydraulic oil lines 254 connecting one or more of control valve 205 outlet ports to shear valve 206. Preferably, the one or more hydraulic oil lines 254 connecting the one or more control valve 205 outlet ports to cylinders 178 and 179 are connected to baling chamber hydraulic oil hub 147, with one or more hydraulic oil lines 254 connecting control valve 205 to baling chamber hydraulic oil hub 147 and one or more hydraulic oil lines connecting baling chamber hydraulic oil hub 147 to cylinders 178 and 179. More preferably, the one or more hydraulic oil lines connecting the one or more control valve 205 outlet ports to cylinders 178 and 179 comprise one or more hydraulic oil lines 254 connected first to baling chamber hydraulic oil line connection plate 246 and one or more hydraulic oil lines 198 and 199 connecting hydraulic oil line connection baling chamber hydraulic oil connection plate 246 to baling chamber hydraulic oil hub 147, with baling chamber hydraulic oil hub 147 connected to cylinders 178 and 179 via one or more hydraulic oil lines.

In a preferred embodiment, control valve 205-baling chamber hydraulic oil hub 147 connections comprise a connection via one or more hydraulic oil lines 254 connecting one or more outlet ports of control valve 205 to first hydraulic oil line 198 and one or more hydraulic oil lines 254 connecting one or more outlet ports of control valve 205 to second hydraulic oil line 199, more preferably one or more hydraulic oil lines 254 connecting one or more outlet ports of control valve 205 to one or more inlet ports of baling chamber hydraulic oil connection plate 246 and lines 198 and 199 connected to one or more outlet ports of baling chamber hydraulic oil connection plate 246 and baling chamber hydraulic oil hub 147, with baling chamber hydraulic oil hub 147 connected to cylinders 178 and 179 via one or more hydraulic oil lines.

Control valve 205 further comprises one or more of levers 253 to control hydraulic oil flow between a source of hydraulic oil of electrical/hydraulic system module 202 and hydraulic cylinder 213 and a source of hydraulic oil of electrical/hydraulic system module 202 and top door hydraulic cylinders 198 and 199 which allow an operator to control modular baler 1 operations. In a preferred embodiment, the one or more levers 253 of control valve 205 comprises (i) a first lever to control hydraulic oil flow to hydraulic cylinders 178 and 179 to allow for closure and opening of top door 170, and (ii) a second lever to control hydraulic oil flow to allow to cylinder 213 for extension and retraction of cylinder rod 216 out of and into cylinder casing 218 of cylinder 200 for baling (compression of uncompressed metal) operations (extension of cylinder rod 216 out of cylinder casing 218) and preparation for the next baling cycle (retraction of cylinder rod 216 into cylinder casing 218).

Pressurized hydraulic oil flows into shear valve 206 from control valve 205 via one or more hydraulic oil lines 254. Shear valve 206 is electrically connected to electrical motor 250*a* and comprises a plurality of hydraulic oil outlet ports, with one or more shear valve 206 outlet ports connected to shear module 280 via one or more hydraulic oil lines for shear module opening operations and with one or more shear valve 206 outlet ports connected to shear module 280 via one or more hydraulic oil lines for shear module closing operations. In a preferred embodiment, shear valve 206-shear module 280 connections comprise one or more hydraulic oil lines connecting one or more outlet ports of shear valve 206 to one or more inlet ports of shear module hydraulic oil connection plate 244 and one or more hydraulic oil lines connecting to one or more outlet ports of shear module hydraulic oil connection plate 244 to shear module 280. Preferably, the one or more hydraulic oil lines from shear valve 206 to shear module 280, whether connected directly to shear module 280 or indirectly via shear module hydraulic oil connection plate 244, extend longitudinally to the anterior of cylinder frame 200 beneath hydraulic oil tank 272 and above cylinder 213. In an embodiment comprising a shear module hydraulic oil connection plate 244, the one or more hydraulic oil lines from shear valve 206 attach to inlet ports on the underside of shear module hydraulic oil connection plate 244.

Shear valve 206 is operated by shear module foot pedal control 282, with depression of shear module foot pedal control 282 opening shear valve 206 which allows for pressurized hydraulic oil to flow through shear valve 206 and into shear module 280 for shear module 280 operations. Shear module foot pedal control 282 is electrically connected to shear valve 206.

Preferably, the outtake (high-pressure side) of hydraulic oil pump 250*b* is, in addition to fluid communication with control valve 205 via one or more hydraulic oil lines 256, in fluid communication with hydraulic oil tank 272, more preferably with such fluid communication comprising hydraulic oil overflow line 273 connecting the outtake of hydraulic oil pump 250*b* to hydraulic oil tank 272. Additionally, and more preferably, hydraulic oil overflow line 273 is in fluid communication with an overflow valve (not pictured in the figures), with the outtake of hydraulic oil pump 250*b* connected via a first portion of hydraulic oil overflow line 273 to the inlet port of overflow valve 274 and the outlet port of overflow valve 274 connected via another portion of hydraulic oil overflow line 273 to hydraulic oil tank 272.

Preferably, attached to a surface at the anterior of cylinder frame 200 are baling chamber hydraulic oil line connection plate 246 and shear module hydraulic oil line connection plate 244, each plate 244 and 246 comprising one or more structural members. Such attaching surface is selected from a group comprising hydraulic oil tank 272 and shear base 284. More preferably, such surface comprises the anterior end of hydraulic oil tank 272.

Baling chamber hydraulic oil line connection plate 246 comprises at least one inlet port in fluid communication with a source of hydraulic oil and at least one outlet port in fluid communication with the at least one inlet port, the plurality of ports connectable with hydraulic oil lines. Preferably, baling chamber hydraulic oil line connection plate 246 comprises two underside ports and two topside ports, more preferably the underside ports being the inlet ports and the topside ports being the outlet ports. In a preferred embodiment, hydraulic oil lines in fluid communication with hydraulic oil tank 272 connect to the inlet ports of baling chamber hydraulic oil line connection plate 246, with the inlet ports preferably being underside ports. Preferably, such fluid communication is via one or more hydraulic oil lines 254 from the outlet of control valve 205. Hydraulic oil lines 198 and 199 from baling chamber 100 connect to the outlet ports of hydraulic oil line connection plate, with the outlet ports preferably being topside ports. More preferably, hydraulic oil lines 198 and 199 in fluid communication with hydraulic cylinders 178 and 179 and from hydraulic oil hub 147 of baling chamber 100 connect to the outlet ports of baling chamber hydraulic oil line connection plate 246, with the outlet ports preferably being topside ports. Preferably, baling chamber hydraulic oil connection plate 244 is attached to shear module hydraulic oil connection plate 246.

Shear module hydraulic oil line connection plate 244 comprises at least one inlet port in fluid communication with a source of hydraulic oil and at least one outlet port in fluid communication with the at least one inlet port. Preferably, shear module hydraulic oil line connection plate 244 comprises two underside ports and two topside ports, more preferably the underside ports being the inlet ports and the topside ports being the outlet ports. In a preferred embodiment, hydraulic oil lines in fluid communication with hydraulic oil tank 272 connect to the inlet ports of shear module hydraulic oil line connection plate 244, with the inlet ports preferably being underside ports. Preferably, such fluid communication is via one or more hydraulic oil lines from the outlet of shear valve 206. One or more shear module hydraulic oil lines 245 of shear module 280 connect to the outlet ports of shear module hydraulic oil line connection plate 244, with the outlet ports preferably being topside ports.

Shear Module: Positioned toward the anterior of cylinder frame 200 is shear module 280 which comprises any one of multiple metallic shearing systems known in the art. Shear module 280 is removably attached to cylinder frame 200, preferably removably attached to shear base 284. Shear base 284 comprises perimeter segments (upper, anterior, and posterior), has an open (hollow) interior extending from the front to the rear of cylinder frame 200, and is removably attached to one of (i) hydraulic tank 272 which in turn is attached to one or more of front structural member 210 and rear structural member 214, preferably both members 210 and 214, and (ii) one or more members 210 and 214, preferably both members 210 and 214.

Preferably, shear module 280 comprises a metal-cutting shear with a hinged jaw, comprising one or more cutting arms, powered by a hydraulic cylinder in fluid communication with a source of hydraulic oil. More preferably, shear module 280 comprises an alligator-type shear as is known and used in the art to cut steel members, such as rebar, pipe, angle iron or 1-beam and long-length metal stock or scrap. Additionally and more preferably, shear module 280 is provided with an adjustable safety guard over the one or more cutting arms. The cutting force of shear module 280 is created by a hydraulic oil system that acts on one or more hydraulic cylinders of the one or more cutting arms, preferably approximately 2500 psig and with a maximum pressure of 3000 psig.

When the cutting of metal by shear module 280 begins, a hydraulically operated hold-down arm of shear module 280 securely locks the metallic piece in place as the one or more cutting arms descends to cleanly shear the metallic piece at the desired angle. At any time during the cutting, a readily accessible emergency stop 248 can be activated to halt the one or more cutting arms of shear module 280 in place if readjustment is required or a potential safety risk has arisen. In a preferred embodiment, emergency stop 248 is directly electrically connected with one or more of electrical motor 250*a* and control panel 204.

Shear module 280 is controlled by shear module foot pedal control 282 which is electrically connected to a source of electricity, preferably via electrical line 258 from shear valve 206 which is electrically connected with electrical motor 250*a*. Additionally and preferably, shear module 280 further comprises a lubrication system that provides periodic lubrication of the one or more cutting arms.

Preferably, the electrical line between shear module foot pedal control 282 and shear module 280 is sufficiently long and flexible to allow for shear module foot pedal control 282 to be positioned below and in front of shear module 280, more preferably sufficiently far enough in front of shear module 280 to safely operate shear module 280. Preferably, when modular baler 1 is not in operation, shear module foot pedal control 282 is stored in the open (hollow) interior of shear base 284, with shear module foot pedal control 282 is removed from the open (hollow) interior of shear base 284 during modular baler 1 operations and placed on a level surface, such as the ground, in the vicinity of the anterior front corner of cylinder frame 200 but to the front and below shear module 280, with the electrical connection between shear module foot pedal control 282 and shear module 280 comprising a flexible electrical line long enough to accommodate placement of shear module foot pedal control 282 on the ground.

Hydraulic oil flows into, through, and out of shear module 280 via one or more shear module hydraulic oil lines 245. Preferably, pressurized oil flows into shear module 280 in one or more shear module hydraulic oil lines 245 flowing from shear valve 206 when an operator depresses shear module foot pedal control 282, which electrically opens shear valve 206, allowing pressurized hydraulic oil to flow through shear valve 206 into shear module 280 in one or more shear module hydraulic oil lines 245. Preferably, hydraulic oil flows from shear valve 206 in hydraulic oil lines that attach to one or more inlet ports on shear module hydraulic oil connection plate 244, with hydraulic oil flowing out of outlet ports on shear module hydraulic oil connection plate 244 to shear module 280 via one or more shear module hydraulic oil lines 245. More preferably, the hydraulic oil lines from shear valve 206 to the inlet ports on shear module hydraulic oil connection plate 244 extend longitudinally to the anterior of cylinder frame 200 beneath hydraulic oil tank 272 and above cylinder 213 and attach to inlet ports on the underside of shear module hydraulic oil connection plate 244, with the outlet ports of shear module hydraulic oil connection plate 244 positioned on the topside of shear module hydraulic oil connection plate 244. More preferably, the one or more shear module hydraulic oil lines 245 comprises two lines, with one line providing hydraulic oil to shear module 280 for opening of the one or more cutting arms and another line providing hydraulic oil to shear module 280 for closing of the one or more cutting arms.

Cylinder Frame Cover: One or more components of the electrical power/hydraulic system module 202 can be covered by cover 270. Cover 270 is removably attached to one or more of front structural member 210, rear structural member 214, and posterior structural member 212 and positioned over one or more of the components of the electrical power/hydraulic system module 202. Preferably, cover 270 is removably attached to front structural member 210 and rear structural member 214.

In a preferred embodiment, cover 270 comprises partial perimeter segments (upper, front, rear), with front perimeter segment attached to front structural member 210, rear perimeter segment attached to rear structural member 214, and upper perimeter segment having a front end and a rear end and that is attached to front perimeter segment at its front end and attached to rear perimeter segment at its rear end. Cover 270 can be comprised of one integral structure or multiple structures attached together. Additionally, and in a preferred embodiment, cover 270 does not have a posterior perimeter segment at the posterior of cylinder frame 200 to allow for ease of access to controls positioned at the posterior of cylinder frame 200 on electrical power/hydraulic system module 202. Cover 270 can also include an anterior perimeter segment proximal the shear module 280. Further, and in a preferred embodiment, cover 270 does not have an anterior perimeter segment.

Moreover, and in a preferred embodiment, cover 270 extends longitudinally from the posterior of cylinder frame 200 to shear base 284 and covers all or a portion of hydraulic oil tank 272. Moreover, and in a preferred embodiment, cover 270 front segment has a cutout to allow for operation of the one or more levers 253 of control valve 205 of electrical power/hydraulic system module 202 by an operator positioned at the front of cylinder frame 200. Furthermore, and in a preferred embodiment, cover 270 rear segment is partially open, preferably with cover meshing 271, to allow for venting of heat coming off electrical motor 250*a*. More preferably, one or more perimeter segments of cover 270 comprises in part meshing 257 to allow for further venting of heat from components of electrical power/hydraulic system module 202. More preferably, meshing 257 is integrated into upper perimeter segment of cover 270.

Attachment of Baling Chamber to Cylinder Frame: The posterior of baling chamber 100 is attachable to the anterior of cylinder frame 200 to form modular baler 1. Baling chamber 100 attaches to cylinder frame 200 at a plurality of attachment points. Preferably, the plurality of attachments points comprises (i) a front attachment point comprised of the insertion of the anterior end of front structural member 210 of cylinder frame 200 into the posterior end of baling chamber front structural member 106, with the securing of the anterior end of front structural member 210 in the interior of baling chamber front structural member 106 accomplished by aligning aperture 120 on the upper perimeter segment of baling chamber front structural member 106 with aperture 240 on the upper perimeter segment of front structural member 210 of cylinder frame 200 and the insertion of front attachment pin 220 into the aligned apertures 120 and 240; (ii) a rear attachment point comprised of the insertion of the anterior end of rear structural member 214 of cylinder frame 200 into the posterior end of baling chamber rear structural member 108, with the securing of the anterior end of rear structural member 214 in the interior of baling chamber rear structural member 108 accomplished by aligning aperture 122 on the upper perimeter segment of baling chamber rear structural member 108 with aperture 242 on the upper perimeter segment of rear structural member 214 of cylinder frame 200 and the insertion of rear attachment pin 222 into the aligned apertures 122 and 242; and (iii) a center attachment point comprised of the insertion of the anterior portion of cylinder rod 216 into the substantially open posterior of pusher block hub 142 to a longitudinal position where aperture 217 of cylinder rod 216 is aligned with aperture 145 on the upper surface of pusher block hub 142 and the insertion of a pusher block pin which secures hydraulic cylinder 213 to pusher block 140. Front attachment pin 220 and rear attachment pin 222 are fully inserted so that the lower portions of pins 220 and 222 protrude from apertures 121 and 123 at the posterior of baling chamber front structural member 106 and baling chamber rear structural member 108, respectively. Additional attachment points can be incorporated.

Operation of Modular Baler: Each of the baling chamber 100 and cylinder frame 200 of modular baler 1 are sized to allow for each to individually fit inside most freight elevators. To operate modular baler 1, cylinder frame 200 and baling chamber 100, having top door 170 open and baling chamber anterior door, comprising baling chamber anterior front door panel 150 and baling chamber anterior rear door panel 160, closed, are positioned in the desired location of operation and attached to each other as described earlier. An electrical connection between electrical power/hydraulic system module 202 and the electricity source is then established via a power cord 203 connected to control panel 204 of electrical power/hydraulic system module 202 and an electricity source. Electrical connections between control panel 204 of electrical power/hydraulic system module 202 and at least electrical motor 250*a*, shear module foot pedal control 282, and emergency stop 248 are established.

An operator utilizes shear module 280, which is in fluid communication with a source of hydraulic oil of electrical power/hydraulic system module 202, to cut uncompressed material which is placed manually by the operator into the open (hollow) interior of baling chamber 100, the open (hollow) interior of baling chamber 100 extending longitudinally from the anterior of pusher block 140, which is positioned at the posterior of baling chamber 100, to baling chamber anterior door and laterally from the baling chamber front wall 104 to the baling chamber rear wall 110, and vertically upward from baling chamber lower structural member 102. Preferably, the operator cuts uncompressed material with shear module 280 to be the approximate length of the open (hollow) interior of baling chamber 100. Moreover, and preferably, the operator distributes uncompressed material uniformly along the longitudinal length of baling chamber 100. When the interior of baling chamber 100 is full or if the operator has completed cutting of material with shear module 280 before completely filling baling chamber 100, the operator stops the operation of shear module 280 and closes top door 170 of baling chamber 100, preferably hydraulically. Preferably, the hydraulic closing of top door 170 is accomplished by hydraulic cylinders 178 and 179 on baling chamber 100 in fluid communication with a source of hydraulic oil on electrical power/hydraulic system module 202, with hydraulic oil flowing to cylinders 178 and 179 and shear module 280 as a result of hydraulic pump 250*b*, which is physically connected to electrical motor 250*a*, pumping hydraulic oil from a source of hydraulic oil to cylinders 178 and 179 and shear module 280. In a preferred embodiment, the operator is able to accomplish the closing of top door 170 by manipulating one or more control levers 253 positioned on a control valve 205 of electrical power/hydraulic system module 202 which regulates flow of hydraulic oil to hydraulic cylinders 278 and 179. More preferably, the operator additionally locks top door 170 through locking handle 192, with such locking accomplished using any one of the multiple known methods in the art.

Baling chamber 100 and cylinder frame 200 are attached at a plurality of attachment points as described above which includes the attachment of hydraulic cylinder 213 to pusher block 140. In a preferred embodiment, cylinder rod 216 of hydraulic cylinder 213 is attached to pusher block 140 by the displacement of cylinder rod 216 in the anterior direction until its anterior end is positioned within pusher block 140. More preferably, the anterior end of cylinder rod 213 is positioned within pusher block hub 142 and a pusher block pin is passed through aperture 145 on pusher block hub 142 and is securely engaged in aperture 217 on cylinder rod 213. Hydraulic oil pump 250*b* causes pressurized hydraulic oil to flow into cylinder 213 via one or more posterior cylinder hydraulic oil ports 209 which allow for the interior of cylinder casing 216 to be in fluid communication with a source of hydraulic oil. The force of pressurized hydraulic oil on cylinder 213, preferably a surface of cylinder rod 216 in the interior of cylinder casing 218, causes the longitudinal displacement of cylinder 213 in the anterior direction, which resultingly causes the longitudinal displacement of pusher block 140 in the same direction, thereby compressing the uncompressed material in the baling chamber 100. More preferably, cylinder rod 216 extends out of cylinder casing 218 and, as a result of attachment to pusher block 140, preferably at the interior of pusher block hub 142, causes the longitudinal displacement of pusher block to the anterior of baling chamber 100, thereby compressing the uncompressed material in the baling chamber 100. In a preferred embodiment, the operator is able to accomplish the longitudinal displacement of hydraulic cylinder 213, preferably cylinder rod 216 of cylinder 213, in the anterior direction by manipulating one or more control levers 253 positioned on a control valve 205 of electrical power/hydraulic system module 202 which regulates flow of hydraulic oil to hydraulic cylinder 213 flowing through one or more posterior cylinder hydraulic oil ports 209.

Hydraulic cylinder 213 operated to push pusher block 140 until a set pressure is reached. Preferably, the set pressure is approximately 2150 psig. Additionally and preferably when hydraulic cylinder 213 has reached a set pressure, a pressure switch sends a signal to light signal 298 to activate light signal 298, such as through the flashing of a lightbulb in light signal 298, to notify the operator that the set pressure has been reached. Once such set pressure is reached, the operator ceases the longitudinal displacement of hydraulic cylinder 213-pusher block 140. The operator opens top door 170, and preferably unlocks top door 170. More preferably, top door 170 is hydraulically moved, with the hydraulic moving of top door 170 accomplished by hydraulic cylinders 178 and 179 on baling chamber 100 in fluid communication with a source of hydraulic oil on electrical power/hydraulic system module 202 and top door 170 is manually unlocked through operator manipulation of top door locking handle 192.

More preferably, in a preferred embodiment, the operator is able to accomplish the opening of top door 170 by manipulating one or more control levers 253 positioned on a control valve 205 of electrical power/hydraulic system module 202 which regulates flow of hydraulic oil to hydraulic cylinders 178 and 179.

The operator opens the baling chamber anterior door, preferably by manipulating handle 165 which causes anterior door closure device 161 to effect the disengagement of baling anterior door from anterior front door frame 180. The operator then removes the compressed material from baling chamber 100, preferably by using the anterior movement of hydraulic cylinder 213-pusher block 140 to push compressed material out of baling chamber anterior door, more preferably by the operator manipulating one or more control levers 253 positioned on a control valve 205 of electrical power/hydraulic system module 202 which regulates flow of hydraulic oil to hydraulic cylinder 213.

To end baling operations, the operator disestablishes the attachment points between cylinder frame 200 and baling chamber 100 and retracts hydraulic cylinder 213 out of the interior of baling chamber 100 by the longitudinal displacement of cylinder rod 216 in the posterior direction. In a preferred embodiment, the retraction of hydraulic cylinder 213 comprises the retraction of cylinder rod 216 out of the interior of baling chamber 100 and into the interior of cylinder casing 218 as a result of longitudinal displacement of cylinder rod 216 in the posterior direction resulting from the force of hydraulic oil on an anterior surface of cylinder rod 216, with such hydraulic oil preferably flowing from a source of hydraulic oil of electrical power/hydraulic system module 202 into cylinder casing 218 via one or more anterior cylinder hydraulic oil ports 219.

Modular baler 1 provides significant volume reduction of scrap waste metal and produces as a byproduct of operation a cube of compacted scrap waste metal. Preferably, modular baler 1 provides volume reduction of approximately 2:1 to approximately 6:1, with resulting byproduct preferably comprising compacted scrap waste metal cubes of approximately 10 inches to approximately 20 inches on its side.

While embodiments of the invention have been illustrated and described, it is not intended that these embodiments illustrate and describe all possible forms of the invention. Rather, the words used in the specification are words of description rather than limitation, and it is understood that various changes may be made without departing from the sprit and scope of the invention.

I claim:

1. A modular baler for use in interior demolition for the single-direction compression of material comprising:

a. a baling chamber sized to fit within an elevator with an upper opening and with a substantially hollow interior and that is substantially open at the anterior and posterior ends, said baling chamber having an anterior door and a top door and means attached to the baling chamber for hydraulically moving the top door upward;

b. a pusher block positioned in the baling chamber interior that is displaceable;

c. a cylinder frame sized to fit within an elevator;

d. a hydraulic cylinder attached to the cylinder frame comprising a cylinder rod that is hydraulically displaceable into and out of a cylinder casing and a plurality of hydraulic oil ports attached to the cylinder casing;

e. an electrical power/hydraulic system module comprising (i) a source of hydraulic oil; (ii) means for connecting to an electrical power source; (iii) an electrical motor electrically connected to an electrical power source through the means; (iv) a hydraulic oil pump electrically connected to the electrical motor and in fluid communication with the source of hydraulic oil and the hydraulic cylinder through the plurality of hydraulic oil ports;

f. a shear module electrically connected to the electrical power source through the means for connecting to an electrical power source and in fluid communication with the source of hydraulic oil; and g. wherein (i) the top door of the baling chamber, when closed, covers the upper opening of the baling chamber, (ii) the baling chamber is attachable to the cylinder frame at a plurality of baling chamber-cylinder frame attachment points and wherein one said attachment point comprises the attachment of the cylinder rod to the pusher block and (iii) the compressed material is fully removable from the baling chamber by using the hydraulically-effectuated movement of the pusher block attached to the cylinder rod to push compressed material out of baling chamber anterior door wherein the cylinder frame and the cylinder rod are configured to be removed from the baling chamber and the pusher block in order to fit INSERT in the elevator.

2. A modular baler as claimed in claim 1, wherein:

a. the electrical power/hydraulic system module further comprises an electrical control panel attached to the means for connecting to an electrical power source, the electrical motor is electrically connected with the electrical control panel, a control valve for operation of the means for hydraulically moving the top door and the cylinder rod, a shear valve electrically connected with the electrical control panel, and wherein the hydraulic oil pump is in fluid communication with the means for hydraulically moving the top door, the control valve, and the shear valve; and c. the shear module is attached to the cylinder frame and is in fluid communication with the source of hydraulic oil through the shear valve.

3. A modular baler as claimed in claim 2 wherein:

a. the baling chamber comprises a front structural member and a rear structural member; a front wall attached to the front structural member and a rear wall attached to the rear structural member; an upper structural member and a lower structural member each attached to the front wall and the rear wall; an anterior door frame attached to one or more of the rear wall, the front wall, the lower structural member and the upper structural member; an anterior door hingedly attached to the anterior door frame wherein the anterior door is closable on the anterior door frame so as to close off the substantially open anterior;

b. the top door is hingedly attached to at least one of the upper structural member and the rear wall;

c. the means for hydraulically moving the top door is attached to at least one of the lower structural member, rear structural member, or rear wall;

d. the cylinder frame comprises a front structural member, a rear structural member, and a posterior structural member attached to each of the front and rear structural members; and e. the baling chamber-cylinder frame attachment points comprise the attachment of the baling chamber front structural member to the cylinder frame front structural member and the attachment of the baling chamber rear structural member to the cylinder frame rear structural member.

4. A modular baler as claimed in claim 3 further comprising a pusher block hub positioned in the interior of the pusher block and the attachment of the hydraulic cylinder rod to the pusher block comprises the attachment of the hydraulic cylinder rod to the pusher block hub.

5. A modular baler as claimed in claim 4 wherein the shape of the pusher block hub is selected from the group comprising substantially cylindrical and substantially rectangular polygonal.

6. A modular baler for use in interior demolition for the single-direction compression of material comprising:

a. a baling chamber sized to fit within an elevator having a substantially hollow interior, anterior and posterior and comprising a front structural member and a rear structural member; a front wall attached to the front structural member and a rear wall attached to the rear structural member; a top door hingedly attached to the rear wall that opens upward; means for locking the top door; an upper structural member and a lower structural member each attached to the front wall and the rear wall; a plurality of top door hydraulic cylinders for hydraulically moving the top door attached to at least one of the lower structural member, rear structural member, and rear wall; an anterior door frame attached to one or more of the rear wall, the front wall, the upper structural member, and the lower structural member; an anterior door hingedly attached to the anterior door frame wherein the anterior door is closable on the anterior door frame so as to close off the substantially open anterior; and a pusher block positioned in the substantially hollow baling chamber interior between the front wall and rear wall wherein the pusher block is displaceable, and has positioned in the pusher block interior a pusher block hub;

b. a cylinder frame sized to fit within an elevator comprising a front structural member, a rear structural member, and a posterior structural member attached to the front structural member and the rear structural member;

c. a hydraulic cylinder attached to the cylinder frame comprising a cylinder rod that is hydraulically displaceable into and out of a cylinder casing and wherein a plurality of hydraulic oil ports is attached to the cylinder casing;

d. an electrical power/hydraulic system module attached to the cylinder frame and comprising (i) a source of hydraulic oil, (ii) means for connecting to an electrical power source, (iii) an electrical control panel attached to the means, (iv) an electrical motor electrically connected with the electrical control panel, (v) a hydraulic oil pump electrically connected to the electrical motor, (vi) a control valve for operation of the top door hydraulic cylinders and the cylinder rod, (vii) a shear valve electrically connected with the electrical control panel, and (viii) wherein the hydraulic oil pump is in fluid communication with the source of hydraulic oil, the hydraulic cylinder through the plurality of hydraulic oil ports, the top door hydraulic cylinders, the control valve, and the shear valve;

e. a shear module (i) attached to the cylinder frame, (ii) in fluid communication with the source of hydraulic oil through the shear valve, and (iii) electrically connected to the control panel; and f. wherein (i) the baling chamber is attachable to the cylinder frame at a plurality of baling chamber-cylinder frame attachment points, (ii) the cylinder rod is attachable to the pusher block hub, and (iii) the compressed material is fully removable from the baling chamber by using the hydraulically-effectuated movement of the pusher block attached to the cylinder rod to push compressed material out of baling chamber anterior door wherein the cylinder frame and the cylinder rod are configured to be removed from the baling chamber and the pusher block in order to fit INSERT in the elevator.

7. A modular baler for use in interior demolition for the single-direction compression of material comprising:

a. a baling chamber sized to fit within an elevator with a substantially hollow interior, a top door that is movable upward, and means for hydraulically moving the top door;

b. a pusher block positioned in the interior of a baling chamber that is displaceable;

c. a pusher block hub positioned in the interior of the pusher block;

d. a cylinder frame sized to fit within an elevator comprising one or more structural members, and one or more lateral support bars, each bar attached to at least one structural member;

e. a hydraulic cylinder (i) attached to at least one of one or more lateral support bars (ii) comprising a cylinder rod that is displaceable into and out of a cylinder casing, wherein a plurality of hydraulic oil ports is attached to the cylinder casing;

f. an electrical power/hydraulic system module attached to the cylinder frame comprising (i) a source of hydraulic oil, (ii) means for connecting to an electrical power source, (iii) an electrical motor electrically connected to an electrical power source through such means; and (iv) a hydraulic oil pump electrically connected to the electrical motor and in fluid communication with the source of hydraulic oil, means for hydraulically moving the top door, and the hydraulic cylinder through the plurality of hydraulic oil ports;

g. a shear module (i) electrically connected to the electrical power source through the means for connecting to the electrical power source and (ii) in fluid communication with the source of hydraulic oil through the hydraulic oil pump; and h. wherein (i) the baling chamber is attachable to the cylinder frame at a plurality of baling chamber-cylinder frame attachment points, (ii) the cylinder rod is attachable to the pusher block hub, and (iii) the compressed material is fully removable from the baling chamber by using the hydraulically-effectuated movement of the pusher block attached to the cylinder rod to push compressed material out of baling chamber anterior door wherein the cylinder frame and the cylinder rod are configured to be removed from the baling chamber and the pusher block in order to fit INSERT in the elevator.

8. A modular baler as claimed in claim 1, wherein the baling chamber further comprises a top door and means for hydraulically moving the top door in fluid communication with the hydraulic oil pump.

9. A modular baler as claimed in claim 7, wherein the baling chamber further comprises means for locking the top door.

10. A modular baler as claimed in claim 7, wherein a. the baling chamber has a substantially open anterior and posterior and comprises a front structural member and a rear structural member; a front wall attached to the front structural member and a rear wall attached to the rear structural member; an upper and a lower structural member each attached to the front wall and the rear wall, an anterior door frame attached to one or more of the rear wall, the front wall, the upper structural member, and the lower structural member; and an anterior door hingedly attached to the anterior door frame wherein the anterior door is closeable on the anterior door frame so as to close off the substantially open anterior of the baling chamber; b. the pusher block is positioned between the front wall and the rear wall; c. the means for hydraulically moving the top door comprises a plurality of hydraulic cylinders, with one each positioned proximal to the anterior and the posterior of the baling chamber; d. wherein the top door is hingedly connected to the rear wall; and e. wherein the electrical power/hydraulic system module further comprises (i) an electrical control panel attached to the means for connecting to the electrical power source, (ii) the electrical motor is electrically connected with the electrical control panel, (iii) a control valve for operation of the top door hydraulic cylinders and the cylinder rod, (iv) a shear valve electrically connected with the electrical control panel, and (v) wherein the hydraulic oil pump is in fluid communication with the top door hydraulic cylinders, the control valve, and the shear valve.

11. A modular baler as claimed in claim 6, further comprising an anterior flange and a posterior flange, each flange attached to the upper structural member.

12. A modular baler as claimed in claim 6, wherein the cylinder frame further comprises a posterior structural member attached to the front structural member and the rear structural member and one or more lateral support bars each attached to the front and the rear structural members.

13. A modular baler as claimed in claim 6 wherein the baling chamber-cylinder frame attachment points comprise the attachment of the baling chamber front structural member to the cylinder frame front structural member and the attachment of the baling chamber rear structural member to the cylinder frame rear structural member.

14. A modular baler as claimed in claim 7 wherein a set of wheels is attached to one or more of the cylinder frame and the baling chamber.

15. A modular baler as claimed in claim 10 wherein the shape of the pusher block hub is selected from the group comprising substantially cylindrical and substantially rectangular polygonal.

16. A modular baler as claimed in claim 6 wherein the shape of the pusher block hub is selected from the group comprising substantially cylindrical and substantially rectangular polygonal.

17. A modular baler as claimed in claim 6 further comprising a cover attachable to one or more cylinder frame structural members and positioned over at least a part of the electrical power/hydraulic system module.

18. A modular baler as claimed in claim 6 wherein the hydraulic cylinders are in fluid communication with the source of hydraulic oil through a hydraulic oil hub attached to the baling chamber.

19. A modular baler as claimed in claim 6, further comprising one or more sets of baling chamber gussets selected from the group comprising one or more gussets between and attached to each of baling chamber upper structural member and baling chamber front structural member, one or more gussets between and attached to each of baling chamber front structural member and baling chamber lower structural member, and one or more gussets between and attached to each of baling chamber rear structural member and baling chamber lower structural member.

20. A modular baler as claimed in claim 6 wherein a set of wheels is attached to one or more of the cylinder frame and the baling chamber.

* * * * *